US011069284B2

(12) United States Patent
Chun

(10) Patent No.: US 11,069,284 B2
(45) Date of Patent: Jul. 20, 2021

(54) LIGHT-EMITTING DISPLAY DEVICE AND METHOD OF DRIVING THE SAME

(71) Applicant: LG Display Co., Ltd., Seoul (KR)

(72) Inventor: Kwangll Chun, Gyeonggi-do (KR)

(73) Assignee: LG DISPLAY CO., LTD, Seoul (KR)

( * ) Notice: Subject to any disclaimer, the term of this patent is extended or adjusted under 35 U.S.C. 154(b) by 0 days.

(21) Appl. No.: 17/071,725

(22) Filed: Oct. 15, 2020

(65) Prior Publication Data

US 2021/0134215 A1 May 6, 2021

(30) Foreign Application Priority Data

Nov. 5, 2019 (KR) ..... 10-2019-0140550

(51) Int. Cl.
*G09G 3/32* (2016.01)

(52) U.S. Cl.
CPC ..... *G09G 3/32* (2013.01); *G09G 2310/0278* (2013.01); *G09G 2310/0294* (2013.01)

(58) Field of Classification Search
CPC ..... G09G 3/32; G09G 2310/0278; G09G 2310/0294
See application file for complete search history.

(56) References Cited

U.S. PATENT DOCUMENTS 10,001,860 B2 * 6/2018 Li ..... G06F 3/0443
10,001,960 B2 * 6/2018 Hoshino ..... G06F 3/1446
10,002,555 B2 * 6/2018 Liu ..... G09G 3/32
10,002,561 B1 * 6/2018 Tridico ..... G09G 3/003

* cited by examiner

*Primary Examiner* — Sejoon Ahn
(74) *Attorney, Agent, or Firm* — Polsinelli PC

(57) ABSTRACT

A light-emitting display device and a method of driving the same including scan signals having a turn-on level voltage concurrently supplied to N scan lines of a plurality of scan lines during a first supply period in which the scan signals having a turn-on level voltage are supplied first, for each of the N scan lines corresponding to N subpixel lines included in each of M blocks into which subpixels are grouped, the scan signals having a turn-on level voltage may be supplied to the N scan lines during a second supply period for each of the N scan lines, in which the scan signals having a turn-on level voltage are supplied second, and time intervals of the N scan lines between the first supply period and the second supply period may be the same or have a difference within a preset range, thereby not only securing sensing and compensating times during driving of an image display through block driving, but also preventing luminance non-uniformity during the block driving.

19 Claims, 21 Drawing Sheets

LIGHT-EMITTING DISPLAY DEVICE AND METHOD OF DRIVING THE SAME

CROSS-REFERENCE TO RELATED APPLICATION

This application claims priority from Korean Patent Application No. 10-2019-0140550, filed on Nov. 5, 2019, which is hereby incorporated by reference for all purposes as if fully set forth herein.

BACKGROUND

Field of the Disclosure

The present disclosure relates to a light-emitting display device and a method of driving the same.

Description of the Background

With the advancement of the information age, various types of light-emitting display devices for displaying images have been developed. Among such light-emitting display devices, there are self-luminous displays in which a backlight unit is not provided outside a display panel and light-emitting elements that emit light by themselves are formed in the display panel.

In the case of such a self-luminous display device, when the light-emitting elements formed in the display panel or driving transistors for driving the light-emitting elements are degraded, image quality can be degraded. Accordingly, when characteristic values (for example, a threshold voltage and the like) of the light-emitting elements or the driving transistors are sensed and deviations thereof are compensated for, the image quality can be improved.

However, there may be a time constraint in driving for sensing and compensating for characteristic values of circuit elements during driving of an image display. That is, with the current technology, it is difficult to secure sensing and compensating times during the driving of the image display.

SUMMARY

The present disclosure is directed to a light-emitting display device that can secure sensing and compensating times through block driving during driving of an image display, and a method of driving the same.

The present disclosure also provides a light-emitting display device, which performs block driving according to various methods allowing luminance non-uniformity due to block driving to be prevented, and a method of driving the same.

The present disclosure also provides a light-emitting display device allowing a luminance deviation to be reduced or removed in a block during block driving, and a method of driving the same.

The present disclosure also provides a light-emitting display device allowing a luminance deviation to be reduced or removed at a block boundary during block driving, and a method of driving the same.

According to an aspect of the present disclosure, there is provided a light-emitting display device including a display panel in which a plurality of data lines and a plurality of scan lines are disposed and including a plurality of subpixels which each include a light-emitting element, a driving transistor configured to control a current flowing in the light-emitting element, a scan transistor configured to transmit a data voltage to the driving transistor, and a storage capacitor configured to maintain a voltage for a certain time and which are disposed in a matrix form, a data driving circuit configured to drive the plurality of data lines, a gate driving circuit configured to drive the plurality of scan lines, and a controller configured to control the data driving circuit and the gate driving circuit.

The plurality of subpixels may be grouped into M blocks, each of the M blocks may include N subpixel lines, and the N subpixel lines included in each of the M blocks may correspond to N scan lines. M may be a natural number of two or more, and N may be a natural number of two or more.

For one frame time, the subpixels disposed in the N subpixel lines included in each of the M blocks may emit light concurrently.

For the one frame time, the gate driving circuit may concurrently supply scan signals having a turn-on level voltage to the N scan lines during a first supply period for each of the N scan lines, in which the scan signals having a turn-on level voltage are supplied first.

For the one frame time, the gate driving circuit may concurrently or sequentially supply the scan signals having a turn-on level voltage to the N scan lines during a second supply period for each of the N scan lines, in which the scan signals having a turn-on level voltage are supplied second.

For the one frame time, the gate driving circuit may supply the scan signals having a turn-off level voltage to the N scan lines during a period between the first supply period and the second supply period for each of the N scan lines.

Time intervals of the N scan lines between the first supply period and the second supply period may be the same or have a difference within a preset range.

The first supply periods of the N scan lines may start concurrently and end sequentially, and the second supply periods of the N scan lines may start sequentially and end sequentially.

The first supply periods of the N scan lines may start concurrently and end concurrently, and the second supply periods of the N scan lines may start concurrently and end sequentially.

According to another aspect of the present disclosure, there is provided a method of driving a light-emitting display device, which includes a display panel in which a plurality of data lines and a plurality of scan lines are disposed and including a plurality of subpixels which each include a light-emitting element, a driving transistor, a scan transistor, and a storage capacitor and which are disposed in a matrix form, a data driving circuit configured to drive the plurality of data lines, and a gate driving circuit configured to drive the plurality of scan lines.

The method of driving a light-emitting display may include concurrently supplying scan signals having a turn-on level voltage to N scan lines of the plurality of scan lines during a first supply period for each of the N scan lines, in which the scan signals having a turn-on level voltage are supplied first for one frame time, wherein N is two or more, after the first supply period for each of the N scan lines, in which the scan signals having a turn-on level voltage are supplied first for the one frame time, supplying the scan signals having a turn-off level voltage to the N scan lines, and concurrently or sequentially supplying the scan signals having a turn-on level voltage to the N scan lines during a second supply period for each of the N scan lines for the one frame time.

The plurality of subpixels may be grouped into M blocks, each of the M blocks may include N subpixel lines, and the N subpixel lines included in each of the M blocks may correspond to the N scan lines. M may be a natural number of two or more, and N may be a natural number of two or more.

For the one frame time, the subpixels disposed in the N subpixel lines included in each of the M blocks may emit light concurrently.

Time intervals of the N scan lines between the first supply period and the second supply period may be the same or have a difference within a preset range.

According to still another aspect of the present disclosure, there is provided a light-emitting display device including a display panel in which a plurality of data lines and a plurality of scan lines are disposed and including a plurality of subpixels which each include a light-emitting element, a driving transistor configured to control a current flowing in the light-emitting element, a scan transistor configured to transmit a data voltage to the driving transistor, and a storage capacitor configured to maintain a voltage for a certain time and which are disposed in a matrix form, a data driving circuit configured to drive the plurality of data lines, a gate driving circuit configured to drive the plurality of scan lines, and a controller configured to control the data driving circuit and the gate driving circuit.

The plurality of subpixels may be grouped into M blocks, each of the M blocks may include N subpixel lines, and the N subpixel lines included in each of the M blocks may correspond to N scan lines. M may be a natural number of two or more, and N may be a natural number of two or more.

For one frame time, the subpixels disposed in the N subpixel lines included in each of the M blocks may emit light concurrently.

For the one frame time, the gate driving circuit may concurrently supply scan signals having a turn-on level voltage to the N scan lines during a first supply period for each of the N scan lines, in which the scan signals having a turn-on level voltage are supplied first.

For the one frame time, the gate driving circuit may supply the scan signals having a turn-on level voltage to the N scan lines during a second supply period for each of the N scan lines, in which the scan signals having a turn-on level voltage are supplied second, The second supply periods of the N scan lines may start non-sequentially at different time points, the second supply periods of the N scan lines may have different time lengths, or during the second supply periods of the N scan lines, data voltages supplied to the subpixels of the N subpixel lines may be different.

According to yet another aspect of the present disclosure, there is provided a method of driving a light-emitting display device, which includes a display panel in which a plurality of data lines and a plurality of scan lines are disposed and including a plurality of subpixels which each include a light-emitting element, a driving transistor, a scan transistor, and a storage capacitor and which are disposed in a matrix form, a data driving circuit configured to drive the plurality of data lines, and a gate driving circuit configured to drive the plurality of scan lines.

The method of driving a light-emitting display device may include concurrently supplying scan signals having a turn-on level voltage to N scan lines of the plurality of scan lines during a first supply period for each of the N scan lines, in which the scan signals having a turn-on level voltage are supplied first for one frame time, wherein N is two or more, after the first supply period for each of the N scan lines for the one frame period, supplying the scan signals having a turn-off level voltage to the N scan lines, and supplying the scan signals having a turn-on level voltage to the N scan lines during a second supply period for each of the N scan lines, in which the scan signals having a turn-on level voltage are supplied second for the one frame time.

The plurality of subpixels may be grouped into M blocks, each of the M blocks may include N subpixel lines, and the N subpixel lines included in each of the M blocks may correspond to the N scan lines. M may be a natural number of two or more, and N may be a natural number of two or more, and For the one frame time, the subpixels disposed in the N subpixel lines included in each of the M blocks may emit light concurrently.

The second supply periods of the N scan lines may start non-sequentially at different time points, the second supply periods of the N scan lines may have different time lengths, or during the second supply period for each of the N scan lines, data voltages supplied to the subpixels of the N subpixel lines may be different.

According to aspects of the present disclosure, through block driving, sensing and compensating times can be secured during driving of an image display.

In addition, according to aspects of the present disclosure, it is possible to perform block driving according to various methods capable of preventing luminance non-uniformity due to the block driving.

Furthermore, according to aspects of the present disclosure, during block driving, it is possible to reduce or remove a luminance deviation in a block.

In addition, according to aspects of the present disclosure, during block driving, it is possible to reduce or remove a luminance deviation at a block boundary.

BRIEF DESCRIPTION OF THE DRAWINGS

The accompanying drawings, which are included to provide a further understanding of the present disclosure and are incorporated in and constitute a part of this application, illustrate aspect(s) of the present disclosure and along with the description serve to explain the principle of the present disclosure.

In the drawings.

DETAILED DESCRIPTION

Figure 1:
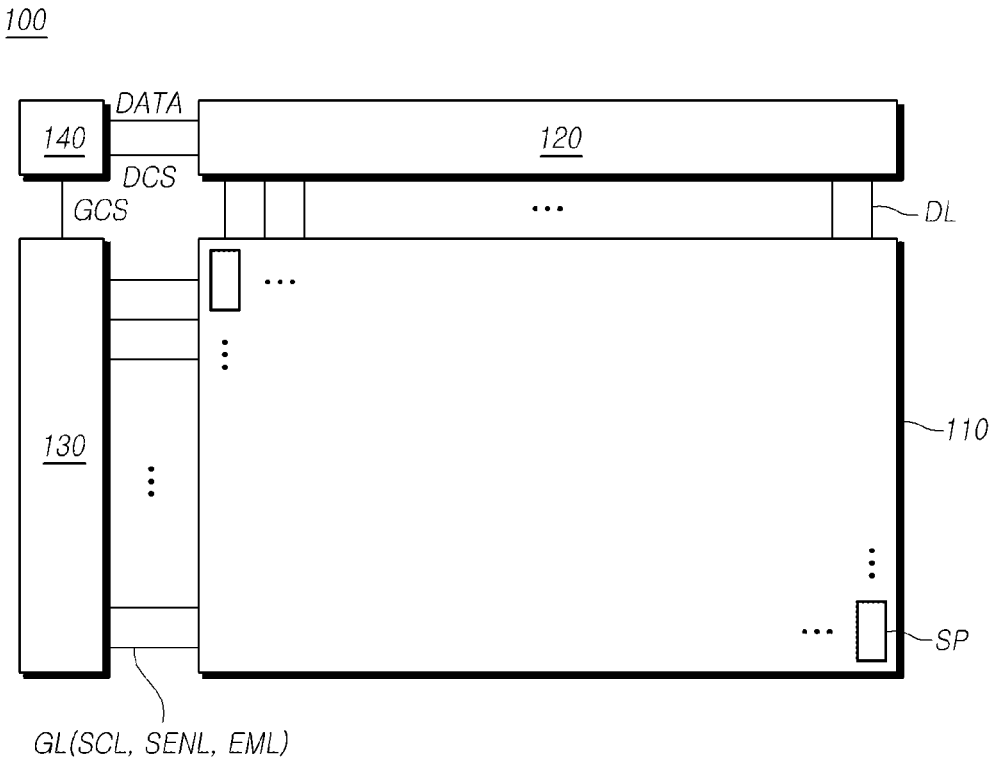
FIG. 1 is a system diagram of a light-emitting display device according to the present disclosure.

In the following description of examples or aspects of the present disclosure, reference will be made to the accompanying drawings in which it is shown by way of illustration specific examples or aspects that can be implemented, and in which the same reference numerals and signs can be used to designate the same or like components even when they are shown in different accompanying drawings from one another. Further, in the following description of examples or aspects of the present disclosure, detailed descriptions of well-known functions and components incorporated herein will be omitted when it is determined that the description may make the subject matter in some aspects of the present disclosure rather unclear. The terms such as "including," "having," "containing," "constituting," "make up of," and "formed of used herein are generally intended to allow other components to be added unless the terms are used with the term "only." As used herein, singular forms are intended to include plural forms unless the context clearly indicates otherwise.

Terms, such as "first," "second," "A," "B," "(A)," or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to," "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to," "contact or overlap," etc. each other via a fourth element. Here, the second element may be included in at least one of two or more elements that "are connected or coupled to," "contact or overlap," etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can."

FIG. 1 is a system diagram of a light-emitting display device 100 according to aspects of the present disclosure.

Referring to FIG. 1, the light-emitting display device 100 according to the present aspects may include a display panel 110 in which a plurality of data lines DL and a plurality of gate lines GL are disposed and a plurality of subpixels SP connected to the plurality of data lines DL and the plurality of gate lines GL are disposed and may include driving circuits which drive the display panel 110.

In terms of a function, the driving circuits may include a data driving circuit 120 for driving the plurality of data lines DL, a gate driving circuit 130 for driving the plurality of gate lines GL, and a controller 140 for controlling the data driving circuit 120 and the gate driving circuit 130.

In the display panel 110, the plurality of data lines DL and the plurality of gate lines GL may be disposed to intersect each other. For example, the plurality of data lines DL may be disposed in rows or columns, and the plurality of gate lines GL may be disposed in column or rows. Hereinafter, for convenience of description, it is assumed that the plurality of data lines DL are disposed in rows and the plurality of gate lines GL are disposed in columns.

The controller 140 supplies various control signals DCS and GCS necessary for driving operations of the data driving circuit 120 and the gate driving circuit 130 to control the data driving circuit 120 and the gate driving circuit 130.

The controller 140 starts scanning according to a timing implemented in each frame, converts input image data input from an external source into a data signal format used in the data driving circuit 120 to output converted image data DATA, and controls data driving at a proper time in accordance with the scanning.

The controller 140 receives various timing signals including a vertical synchronization signal Vsync, a horizontal synchronization signal Hsync, an input data enable (DE) signal, and a clock signal CLK, as well as the input image data, from the external source (for example, a host system).

The controller 140 not only converts the input image data input from the external source into the data signal format used in the data driving circuit 120 and outputs the converted image data DATA, but also receives the various timing signals including the vertical synchronization signal Vsync, the horizontal synchronization signal Hsync, the input DE signal, and the clock signal and generates and outputs various control signals to the data driving circuit 120 and the gate driving circuit 130 in order to control the data driving circuit 120 and the gate driving circuit 130.

For example, the controller 140 outputs various gate control signals GCS including a gate start pulse (GSP), a gate shift clock (GSC) signal, a gate output enable (GOE) signal, and the like in order to control the gate driving circuit 130. Here, the GSP controls an operation start timing of one or more gate-driver integrated circuits (G-DICs) constituting the gate driving circuits 130. The GSC signal is a clock signal commonly input to one or more G-DICs and controls a shift timing of a scan signal (gate pulse). The GOE signal designates timing information of one or more G-DICs.

In addition, the controller 140 outputs various data control signals DCS including a source start pulse (SSP), a source sampling clock (SSC) signal, a source output enable (SOE) signal, and the like in order to control the data driving circuit 120. Here, the SSP controls a data sampling start timing of one or more source driver integrated circuits constituting the data driving circuit 120. The SSC signal is a clock signal for controlling a data sampling timing of each of the source driver integrated circuits. The SOE signal controls an output timing of the data driving circuit 120.

The controller 140 may be a timing controller that is used in common display technology or may be a control device that includes a timing controller to further perform other control functions.

The controller 140 may be implemented as a component that is separate from the data driving circuit 120 and may be integrated with the data driving circuit 120 to be implemented as one integrated circuit.

The data driving circuit 120 receives the image data DATA from the controller 140 and supplies data voltages to the plurality of data lines DL to drive the plurality of data lines DL. Here, the data driving circuit 120 is also referred to as a source driving circuit.

The data driving circuit 120 may be implemented to include one or more source-driver integrated circuits (S-DICs). Each S-DIC may include a shift register, a latch circuit, a digital-to-analog converter (DAC), an output buffer, and the like. Each S-DIC may further include an analog-to-digital converter (ADC) in some cases.

Each S-DIC may be connected to a bonding pad of the display panel 110 through a tape-automated bonding (TAB) method or a chip-on glass (COG) method, may be disposed directly in the display panel 110, or may be disposed to be integrated into the display panel 110 in some cases. In addition, each S-DIC may be implemented through a chip-on film (COF) method so as to be mounted on a source-circuit film connected to the display panel 110.

The gate driving circuit 130 sequentially supplies scan signals to the plurality of gate lines GL to sequentially drive the plurality of gate lines GL. Here, the gate driving circuit 130 is also referred to as a scan driving circuit.

The gate driving circuit 130 may include a shift register, a level shifter, and the like.

The gate driving circuit 130 may be connected to the bonding pad of the display panel 110 through a TAB method or a COG method, may be implemented as a gate-in panel (GIP) type to be disposed directly in the display panel 110, or may be disposed to be integrated into the display panel 110 in some cases. In addition, the gate driving circuit 130 may be implemented using a plurality of G-DICs and may be implemented through a COF method so as to be mounted on a gate-circuit film connected to the display panel 110.

The gate driving circuit 130 sequentially supplies scan signals having an on-voltage or off-voltage to the plurality of gate lines GL under control of the controller 140.

When a specific gate line is enabled by the gate driving circuit 130, the data driving circuit 120 converts the image data DATA received from the controller 140 into data voltages having an analog form and supplies the data voltages to the plurality of data lines DL.

The data driving circuit 120 may be positioned only at one side (for example, an upper side or a lower side) of the display panel 110. In some cases, the data driving circuit 120 may be positioned at both sides (for example, the upper side and the lower side) of the display panel 110 according to a driving method, a panel design method, and the like.

The gate driving circuit 130 may be positioned only at one side (for example, a left side or a right side) of the display panel 110. In some cases, the gate driving circuit 130 may be positioned at both sides (for example, the left side and the right side) of the display panel 110 according to a driving method, a panel design method, and the like.

The plurality of gate lines GL disposed in the display panel 110 may include a plurality of scan lines SCL, a plurality of sense lines SENL, and a plurality of emission control lines EML. The scan line SCL, the sense line SENL, and the emission control line EML are lines for transmitting different types of signals (scan signal, sense signal, and emission control signal) to gate nodes of different types of transistors (scan transistor, sense transistor, and emission control transistor). Hereinafter, descriptions will be given with reference to FIG. 2.

The light-emitting display device 100 according to the present aspects may be a self-luminous display such as an organic light-emitting diode (OLED) display, a quantum dot display, or a micro light-emitting diode (LED) display.

When the light-emitting display device 100 according to the present aspects is the OLED display, each subpixel SP may include an OLED, which emits light by itself, as a light-emitting element. When the light-emitting display device 100 according to the present aspects is the quantum dot display, each subpixel SP may include a light-emitting element made of quantum dots which are semiconductor crystals which emit light by themselves. When the light-emitting display device 100 according to the present aspects is the LED display, each subpixel SP may include a micro LED, which emits light by itself and is made based on an inorganic material, as a light-emitting element.

Figure 2:
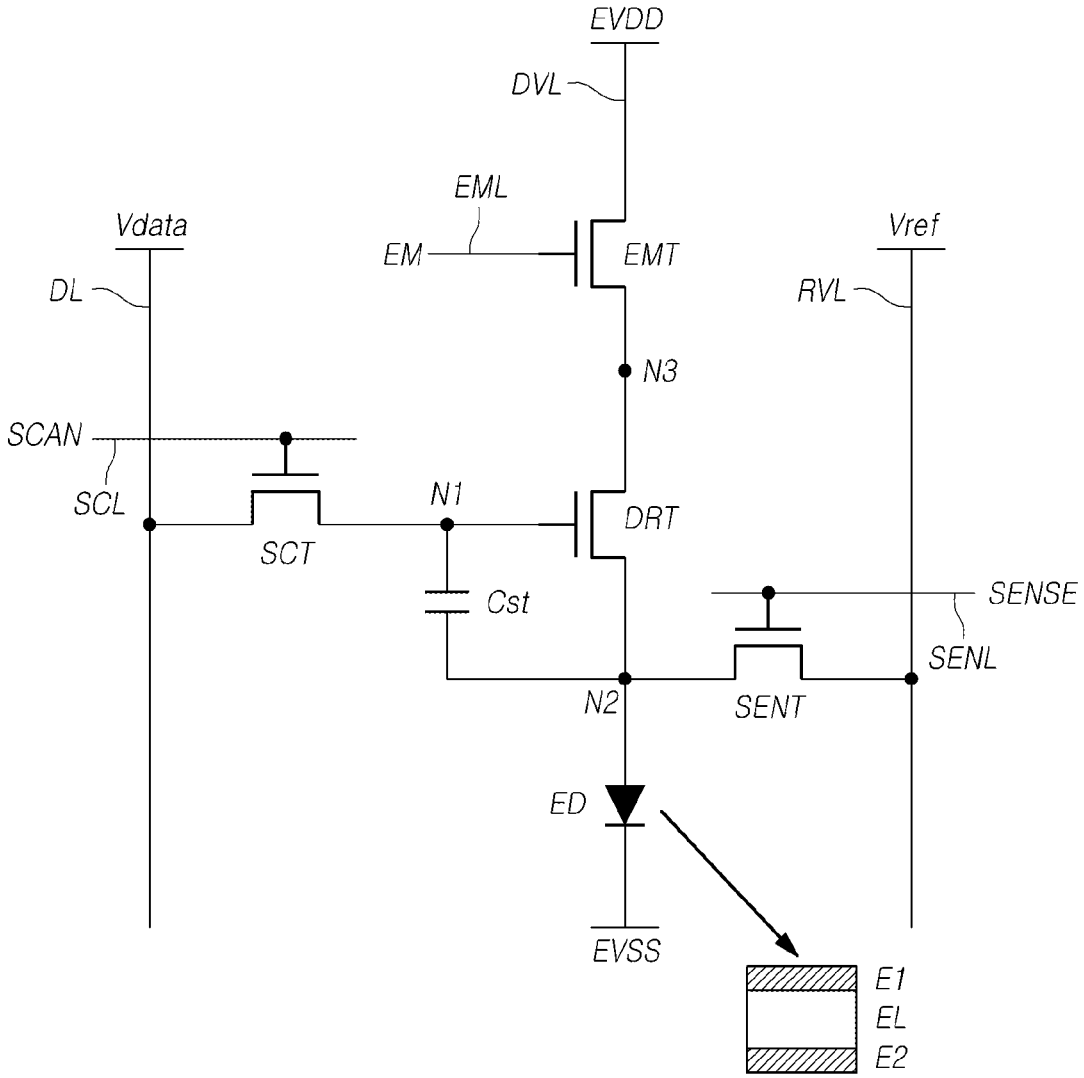
FIG. 2 is an equivalent circuit of a subpixel of the light-emitting display device according to the present disclosure.

FIG. 2 is an equivalent circuit of the subpixel SP of the light-emitting display device 100 according to aspects of the present disclosure.

Referring to FIG. 2, in the light-emitting display device 100 according to the aspects of the present disclosure, each subpixel SP may include a light-emitting element ED, a driving transistor DRT for controlling a current flowing in the light-emitting element ED, a scan transistor SCT for transmitting a data voltage Vdata to the driving transistor DRT, a sense transistor SENT for an initialization operation, an emission control transistor EMT for emission control, a storage capacitor Cst for maintaining a voltage for a certain period, and the like.

The light-emitting element ED includes a first electrode E1, a second electrode E2, and a light-emitting layer EL positioned between the first electrode E1 and the second electrode E2. In the light-emitting element ED, the first electrode E1 may be an anode or a cathode, and the second electrode E2 may be a cathode or an anode. The light-emitting element ED may be, for example, an OLED, an LED, a quantum dot light-emitting element, or the like.

The second electrode E2 of the light-emitting element ED may be a common electrode. In this case, a base voltage EVSS may be applied to the second electrode E2 of the light-emitting element ED. Here, the base voltage EVSS may be, for example, a ground voltage or a voltage similar to the ground voltage.

The driving transistor DRT is a transistor for driving the light-emitting element ED and includes a first node N1, a second node N2, and a third node N3.

The first node N1 of the driving transistor DRT may be a node corresponding to a gate node and may be electrically connected to a source node or a drain node of the scan transistor SCT. The second node N2 of the driving transistor DRT may be electrically connected to the first electrode E1 of the light-emitting element ED and may be a source node or a drain node. The third node N3 of the driving transistor DRT may be a node to which a driving voltage EVDD is applied, may be electrically connected to a driving voltage line DVL for supplying the driving voltage EVDD, and may be a drain node or a source node. Hereinafter, for convenience of description, an example in which the second node N2 of the driving transistor DRT is a source node and the third node N3 thereof is a drain node will be described.

The scan transistor SCT may control a connection between the first node N1 of the driving transistor DRT and a corresponding data line DL of the plurality of data lines DL in response to a scan signal SCAN supplied from a corresponding scan line SCL of the plurality of scan lines SCL, which is a type of the gate line GL.

The drain node or the source node of the scan transistor SCT may be electrically connected to the corresponding data line DL. The source node or the drain node of the scan transistor SCT may be electrically connected to the first node N1 of the driving transistor DRT. A gate node of the scan transistor SCT may be electrically connected to the scan line SCL, which is a type of the gate line GL, to receive the scan signal SCAN.

The scan transistor SCT may be turned on by the scan signal SCAN having a turn-on level voltage to transmit the data voltage Vdata supplied from the corresponding data line DL to the first node N1 of the driving transistor DRT.

The scan transistor SCT is turned on by the scan signal SCAN having a turn-on level voltage and turned off by the scan signal SCAN having a turn-off level voltage. Here, when the scan transistor SCT is an n-type, the turn-on level voltage may be a high level voltage, and the turn-off level voltage may be a low level voltage. When the scan transistor SCT is a p-type, the turn-on level voltage may be a low level voltage, and the turn-off level voltage may be a high level voltage.

The sense transistor SENT may control a connection between the second node N2 of the driving transistor DRT electrically connected to the first electrode E1 of the light-emitting element ED and a corresponding reference line RVL of a plurality of reference lines RVL in response to a sense signal SENSE supplied from a corresponding sense line SENL of the plurality of sense lines SENL, which is a type of the gate line GL.

A drain node or a source node of the sense transistor SENT may be electrically connected to the reference line RVL. The source node or the drain node of the sense transistor SENT may be electrically connected to the second node N2 of the driving transistor DRT and electrically connected to the first electrode E1 of the light-emitting element ED. A gate node of the sense transistor SENT may be electrically connected to the sense line SENL, which is a type of the gate line GL, to receive the sense signal SENSE.

The sense transistor SENT may be turned on to apply the reference voltage Vref supplied from the reference line RVL to the second node N2 of the driving transistor DRT.

The sense transistor SENT is turned on by the sense signal SENSE having a turn-on level voltage and turned off by the sense signal SENSE having a turn-off level voltage. Here, when the sense transistor SENT is an n-type, the turn-on level voltage may be a high level voltage, and the turn-off level voltage may be a low level voltage. When the sense transistor SENT is a p-type, the turn-on level voltage may be a low level voltage, and the turn-off level voltage may be a high level voltage.

The emission control transistor EMT may control a connection between the third node N3 of the driving transistor DRT and a corresponding driving voltage line DVL of a plurality of driving voltage lines DVL in response to an emission control signal EM supplied from a corresponding emission control line EML of the plurality of emission control lines EML, which is a type of the gate line GL. That is, as shown in FIG. 2, the emission control transistor EMT may be electrically connected between the third node N3 of the driving transistor DRT and the driving voltage line DVL.

A drain node or a source node of the emission control transistor EMT may be electrically connected to the driving voltage line DVL. The source node or the drain node of the emission control transistor EMT may be electrically connected to the third node N3 of the driving transistor DRT. A gate node of the emission control transistor EMT may be electrically connected to the emission control line EML, which is a type of the gate line GL, to receive the emission control signal EM.

Alternatively, the emission control transistor EMT may also control a connection between the second node N2 of the driving transistor DRT and the first electrode E1 of the light-emitting element ED. That is, unlike what is shown in FIG. 2, the emission control transistor EMT may be electrically connected between the second node N2 of the driving transistor DRT and the light-emitting element ED.

The emission control transistor EMT is turned on by the emission control signal EM having a turn-on level voltage and turned off by the emission control signal EM having a turn-off level voltage. Here, when the emission control transistor EMT is an n-type, the turn-on level voltage may be a high level voltage, and the turn-off level voltage may be a low level voltage. When the emission control transistor EMT is a p-type, the turn-on level voltage may be a low level voltage, and the turn-off level voltage may be a high level voltage.

The storage capacitor Cst may be electrically connected between the first node N1 and the second node N2 of the driving transistor DRT to maintain the data voltage Vdata corresponding to an image signal voltage or a voltage corresponding thereto for one frame time.

The storage capacitor Cst may be an external capacitor intentionally designed outside the driving transistor DRT rather than a parasitic capacitor (for example, Cgs or Cgd) that is an internal capacitor between the first node N1 and the second node N2 of the driving transistor DRT.

Each of the driving transistor DRT, the scan transistor SCT, the sense transistor SENT, and the emission control transistor EMT may be an n-type transistor or a p-type transistor. All of the driving transistor DRT, the scan transistor SCT, the sense transistor SENT, and the emission control transistor EMT may be an n-type transistor or a p-type transistor. At least one of the driving transistor DRT, the scan transistor SCT, the sense transistor SENT, and the emission control transistor EMT may be an n-type transistor (or a p-type transistor), and the remainder thereof may be a p-type transistor (or an n-type transistor).

A structure of each subpixel shown in FIG. 2 is merely an example for description, and each subpixel may further include one or more transistors or may further include one or more capacitors in some cases. Alternatively, the plurality of subpixels may have the same structure, and some of the plurality of subpixels may have different structures.

Figure 3:
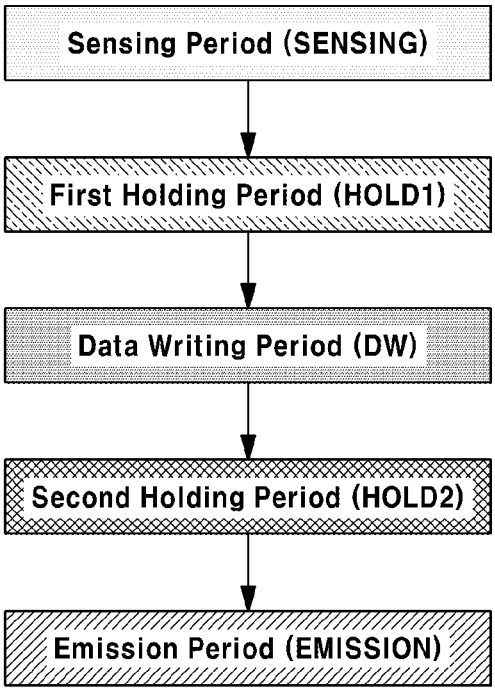
FIG. 3 is a diagram illustrating basic driving periods of the light-emitting display device according to the present disclosure.
Figure 4:
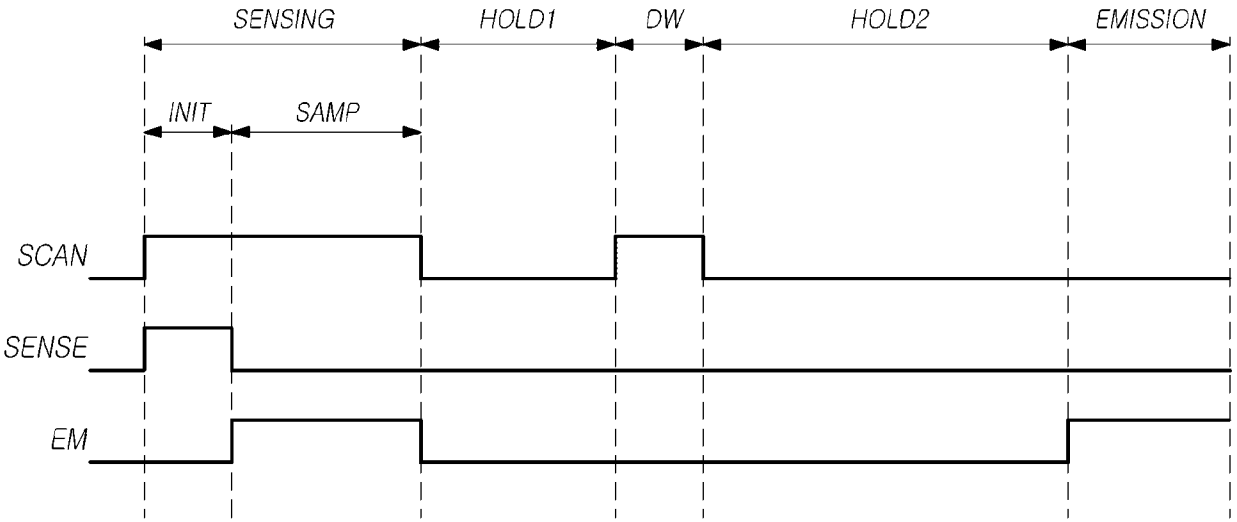
FIG. 4 is a diagram illustrating gate signals applied to the subpixel during driving of the subpixel of the light-emitting display device according to the present disclosure.

FIG. 3 is a diagram illustrating basic driving periods of the light-emitting display device 100 according to aspects of the present disclosure, and FIG. 4 is a diagram illustrating the gate signals SCAN, SENSE, and EM applied to the subpixel SP during driving of the subpixel SP of the light-emitting display device 100 according to aspects of the present disclosure.

Referring to FIG. 3, a driving time of each subpixel SP of the light-emitting display device 100 according to the aspects of the present disclosure may include a sensing period SENSING a first holding period HOLD1, a data writing period DW, a second holding period HOLD2, and an emission period EMISSION.

Referring to FIGS. 3 and 4, the sensing period SENSING is a period in which characteristic values (for example, a threshold voltage and mobility) of the driving transistor DRT are sensed. The sensing period SENSING may include an initialization period INIT and a sampling period SAMP.

Referring to FIG. 4, during the initialization period INIT in the sensing period SENSING the scan transistor SCT is turned on by the scan signal SCAN having a turn-on level voltage, and the sense transistor SENT is turned on by the sense signal SENSE having a turn-on level voltage.

Accordingly, the data voltage Vdata for sensing driving is applied to the first node N1 of the driving transistor DRT, and a reference voltage Vref is applied to the second node N2 of the driving transistor DRT, and thus, the first node N1 and the second node N2 of the driving transistor DRT are initialized. During the initialization period INIT, the emission control transistor EMT may be turned off by the emission control signal EM having a turn-off level voltage.

Referring to FIG. 4, during the sampling period SAMP in the sensing period SENSING; the scan transistor SCT is turned on by the scan signal SCAN having a turn-on level voltage, and the sense transistor SENT is turned off by the sense signal SENSE having a turn-off level voltage. During the sampling period SAMP, the emission control transistor EMT may be turned on by the emission control signal EM having a turn-on level voltage. Accordingly, the first node N1 of the driving transistor DRT is in a state in which the data voltage Vdata for sensing driving is applied thereto, and the second node N2 of the driving transistor DRT is in a floating state. A voltage of the second node N2 of the driving transistor DRT is boosted and then is saturated after a certain time. The saturated voltage of the second node N2 of the driving transistor DRT corresponds to a voltage (Vdata-Vth) obtained by subtracting a threshold voltage Vth of the driving transistor DRT from the data voltage Vdata for sensing driving of the first node N1 of the driving transistor DRT.

Referring to FIG. 4, the first holding period HOLD1 is a period before the data writing period DW proceeds and after the sensing period SENSING During the first holding period HOLD1, the scan transistor SCT, the sense transistor SENT, and the emission control transistor EMT may be in a state of being turned off. During the first holding period HOLD1, the voltage of the second node N2 of the driving transistor DRT rises due to a conduction current of the driving transistor DRT. In this case, since a potential difference between the first node N1 and the second node N2 of the driving transistor DRT is induced, voltages of the first node N1 and the second node N2 of the driving transistor DRT may vary (rise) together.

Referring to FIG. 4, the data writing period DW is a period for determining a driving current flowing in the light-emitting element ED and is a period in which the data voltage Vdata for image display is applied to the first node N1 of the driving transistor DRT. In this case, due to a driving operation of the sensing period SENSING the driving current flowing in the light-emitting element ED may be determined regardless of the threshold voltage of the driving transistor DRT. Accordingly, luminance non-uniformity due to a threshold voltage deviation between the driving transistors DRT does not occur. Therefore, the sensing period SENSING is also referred to as an internal compensation period in which the threshold voltage deviation between the driving transistors DRT is compensated for.

Referring to FIG. 4, during the data writing period DW, the scan transistor SCT is turned on by the scan signal SCAN having a turn-on level voltage. Accordingly, the scan transistor SCT transmits the data voltage VDTA for image display supplied to the data line DL to the first node N1 of the driving transistor DRT. Here, the first node N1 of the driving transistor DRT is electrically connected to one electrode of the storage capacitor Cst. Therefore, during the data writing period DW, electric charges corresponding to the data voltage VDTA for image display are charged in the storage capacitor Cst.

Referring to FIG. 4, the second holding period HOLD2 is a period before the emission period EMISSION proceeds and after the data writing period DW. During the second holding period HOLD2, the scan transistor SCT, the sense transistor SENT, and the emission control transistor EMT may be in a state of being turned off. During the second holding period HOLD2, a voltage of the second node N2 of the driving transistor DRT rises due to a conduction current of the driving transistor DRT. In this case, since a potential difference between the first node N1 and the second node N2 of the driving transistor DRT is induced, voltages of the first node N1 and the second node N2 of the driving transistor DRT may rise together.

When the rising voltage of the second node N2 of the driving transistor DRT (that is, a voltage of the first electrode E1 of the light-emitting element ED) is greater than or equal to a certain voltage (voltage obtained by adding a threshold voltage of the light-emitting element ED to a voltage of the second electrode E2 of the light-emitting element ED), the light-emitting element ED starts to emit light.

Referring to FIG. 4, the emission period EMISSION is a period in which the light-emitting element ED actually emits light. During the emission period EMISSION, the emission control transistor EMT is turned on by the emission control signal EM having a turn-on level voltage such that the light-emitting element ED emits light. In this case, emission luminance of the light-emitting element ED is proportional to the driving current flowing in the light-emitting element ED. The emission period EMISSION occupies most of one frame time.

Figure 5:
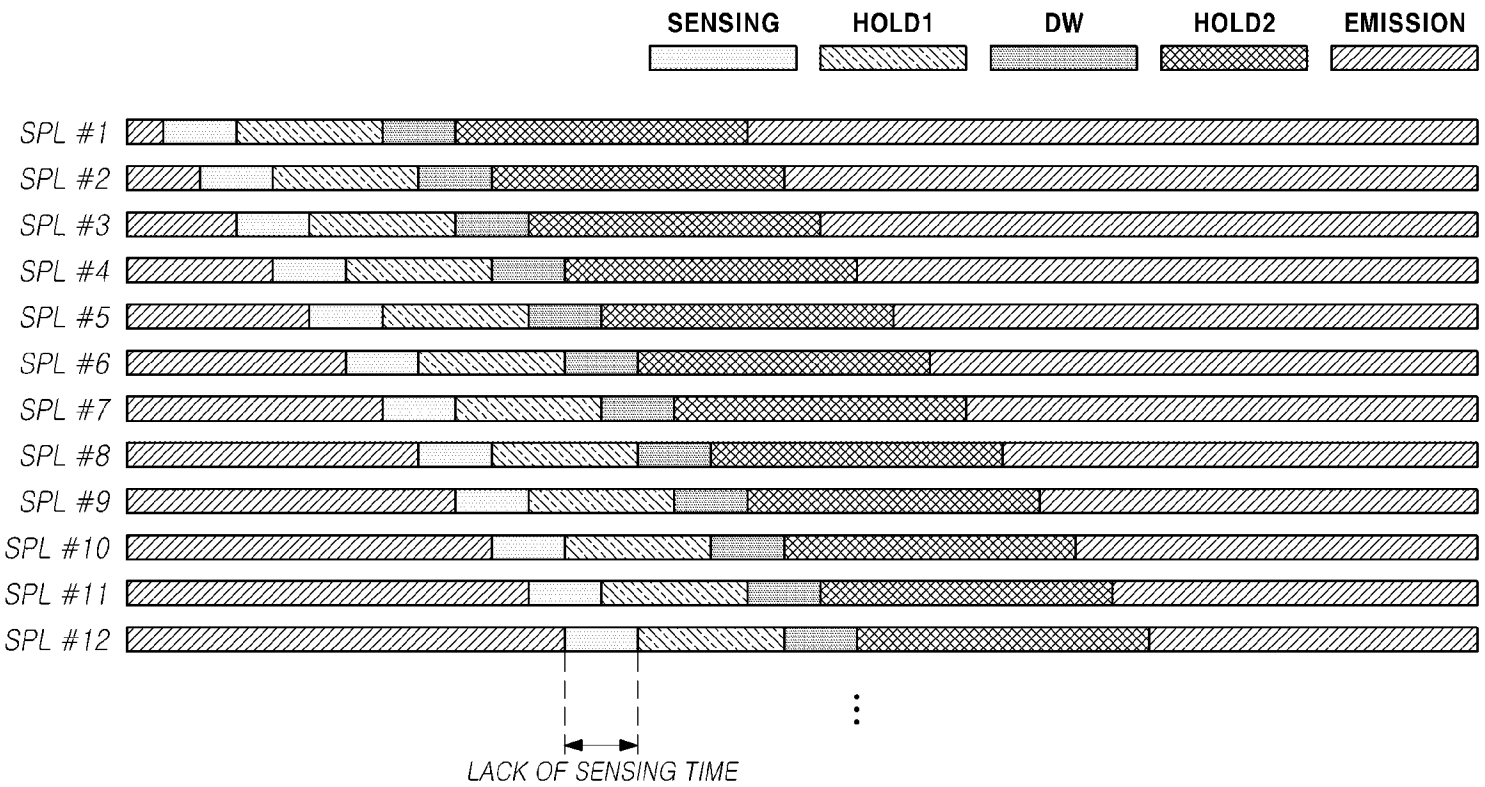
FIG. 5 is a timing diagram of individual driving of the light-emitting display device according to aspects of the present disclosure.

FIG. 5 is a timing diagram of individual driving of the light-emitting display device 100 according to aspects of the present disclosure.

Referring to FIG. 5, the plurality of subpixels SP are disposed in a matrix form in the display panel 110. Accordingly, a plurality of subpixel lines SPL #1, SPL #2, SPL #3, SPL #4, SPL #5, SPL #6, . . . , may be present in the display panel 110.

Referring to FIG. 5, the plurality of subpixel lines SPL #1, SPL #2, SPL #3, SPL #4, SPL #5, SPL #6, . . . , may be individually and sequentially driven.

In the plurality of subpixel lines SPL #1, SPL #2, SPL #3, SPL #4, SPL #5, SPL #6, . . . , sensing periods SENSING proceed sequentially, first holding periods HOLD1 proceed sequentially, data writing periods DW proceed sequentially, and second holding periods HOLD2 proceed.

During the sensing period SENSING of each subpixel SP, a time (sensing time) is required to perform sensing and compensating (internal compensating) on a threshold voltage of the driving transistor DRT of each subpixel SP to raise and saturate a voltage of the second node N2 of the driving transistor DRT until a voltage difference between the first node N1 and the second node N2 of the driving transistor DRT is equal to the threshold voltage of the driving transistor DRT. However, when the sensing period SENSING is not secured for as long as the sensing time, the compensation for the threshold voltage is not performed normally.

As described above, when the plurality of subpixel lines SPL #1, SPL #2, SPL #3, SPL #4, SPL #5, SPL #6, . . . , are individually and sequentially driven, it is difficult to secure the sensing period SENSING for as long as the required time.

Accordingly, the aspects of the present disclosure propose a block driving method in which the plurality of subpixel lines SPL #1, SPL #2, SPL #3, SPL #4, SPL #5, SPL #6, . . . , are grouped into a number of blocks and two or more subpixel lines included in one block are concurrently driven. Hereinafter, some aspects of the block driving method will be described.

Figure 6:
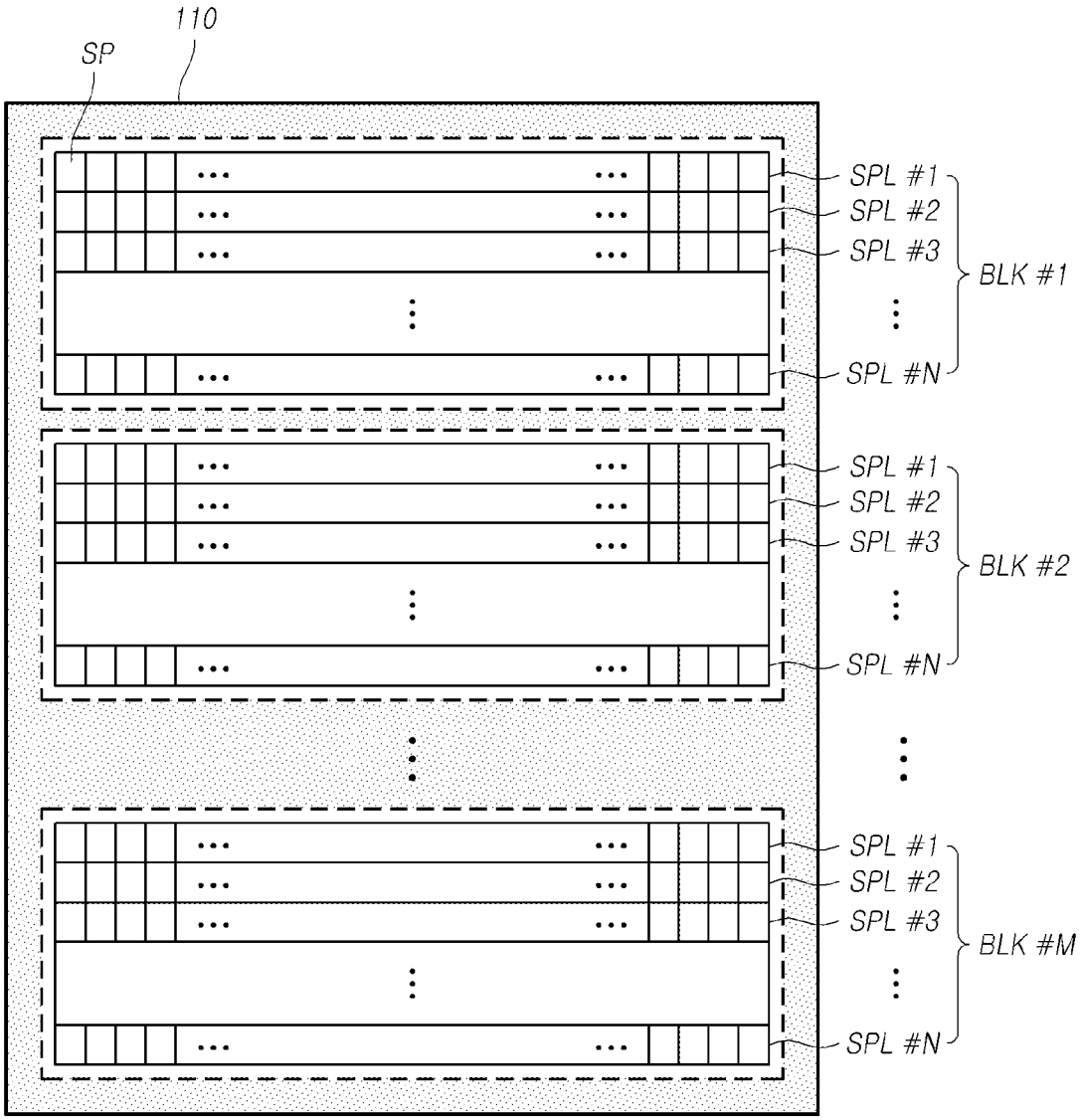
FIG. 6 is an exemplary diagram illustrating blocks for block driving of the light-emitting display device according to the present disclosure.

FIG. 6 is an exemplary diagram illustrating blocks BLK #1 to BLK #M (M>2) for block driving of the light-emitting display device 100 according to aspects of the present disclosure.

Referring to FIG. 6, a plurality of subpixels SP are grouped into M blocks BLK #1 to BLK #M. M may be a natural number of two or more.

Referring to FIG. 6, each of the M blocks BLK #1 to BLK #M may include N subpixel lines SPL #1 to SPL #N. N may be a natural number of two or more. A number of subpixels SP are disposed in each of the N subpixel lines SPL #1 to SPL #N.

Figure 7:
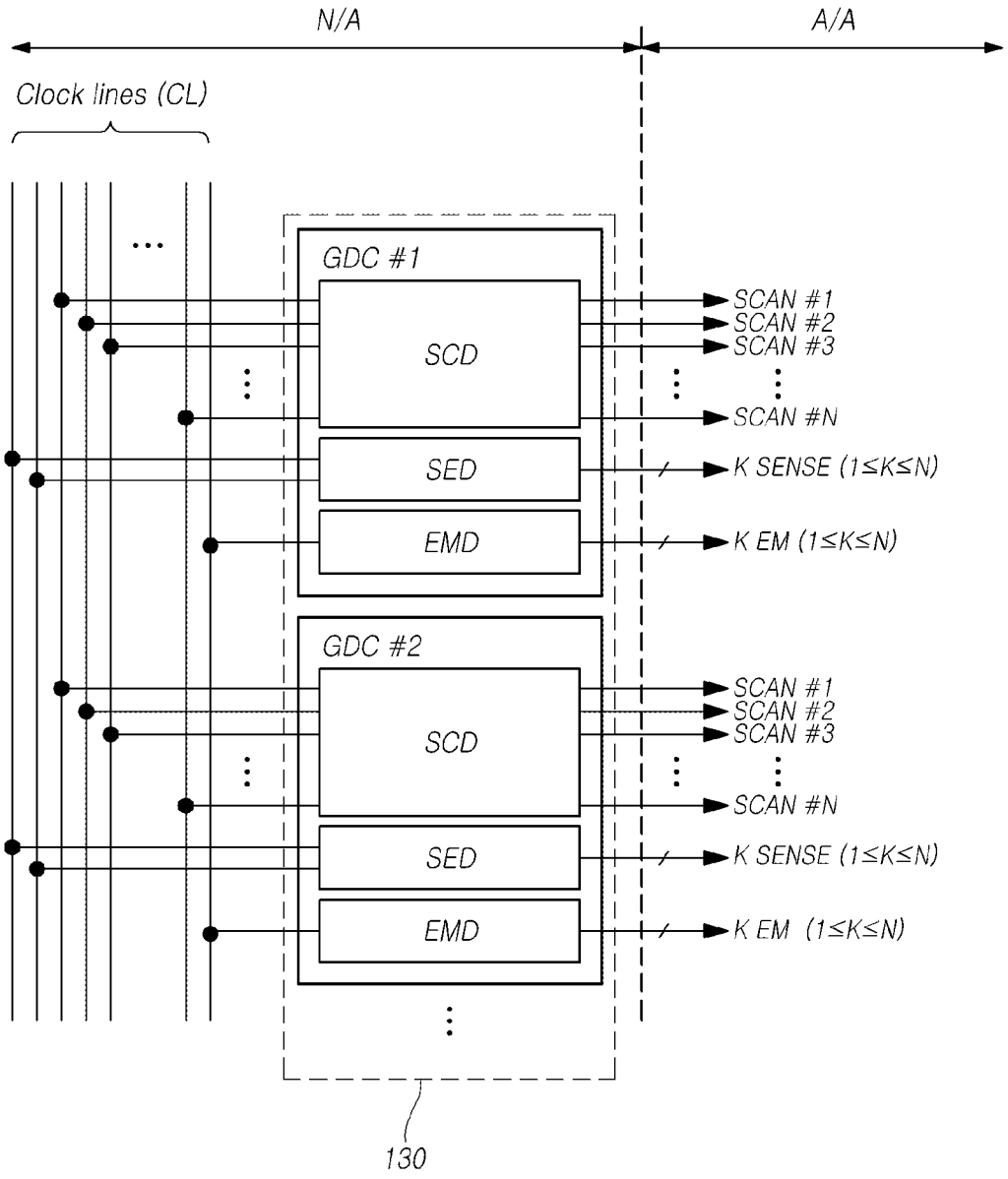
FIG. 7 is a diagram illustrating a gate driving circuit in a gate-in panel (GIP) type for block driving of the light-emitting display device according to the present disclosure.

FIG. 7 is a diagram illustrating the gate driving circuit 130 in a GIP type for block driving of the light-emitting display device 100 according to aspects of the present disclosure.

Referring to FIG. 7, when the gate driving circuit 130 is the GIP type, the gate driving circuit 130 may be disposed in a non-active area N/A that is a peripheral area of an active area A/A in which an image is displayed.

Referring to FIG. 7, the gate driving circuit 130 requires clock signals having various phases to output scan signals SCAN, sense signals SENSE, and emission control signals EM according to a driving timing. To this end, clock lines CL are disposed in the non-active area N/A.

Referring to FIG. 7, in order to drive scan lines SCL, sense lines SENL, and emission control lines EML corresponding to three types of gate lines GL, the gate driving circuit 130 may include scan drivers SCD for outputting the scan signals SCAN to the scan lines SCL, sense drivers SED for outputting the sense signals SENSE to the sense lines SENL, and emission control drivers EMD for outputting the emission control signals EM to the emission control lines EML.

Referring to FIG. 7, for block driving, the gate driving circuit 130 may include the scan driver SCD, the sense driver SED, and the emission control driver EMD for each of the M blocks BLK #1 to BLK #M.

For example, a first gate driving circuit GDC #1 for a first block BLK #1 of the M blocks BLK #1 to BLK #M may include the scan driver SCD for outputting N scan signals SCAN #1 to SCAN #N to drive N scan lines SCL disposed in the first block BLK #1, the sense driver SED for outputting K sense signals SENSE to drive K sense lines SENL (1<K<N) disposed in the first block BLK #1, and the emission control driver EMD for outputting K emission control signals EM to drive K emission control lines EML (1<K<N) disposed in the first block BLK #1.

For example, a second gate driving circuit GDC #2 for a second block BLK #2 of the M blocks BLK #1 to BLK #M may include the scan driver SCD for outputting N scan signals SCAN #1 to SCAN #N to drive N scan lines SCL disposed in the second block BLK #2, the sense driver SED for outputting K sense signals SENSE to drive K sense lines SENL (1<K<N) disposed in the second block BLK #2, and the emission control driver EMD for outputting K emission control signals EM to drive K emission control lines EML (1<K<N) disposed in the second block BLK #2.

In order to generate and output the N scan signals SCAN #1 to SCAN #N to the N scan lines SCL, the scan driver SCD provided in each block unit may include a pull-up transistor and a pull-down transistor with respect to each of the N scan lines SCL and may include a control circuit for controlling a gate node (Q node) of the pull-up transistor and a gate node (QB node) of the pull-down transistor.

In order to generate and output the K sense signals SENSE to the K sense lines SENL, the sense driver SED provided in each block unit may include a pull-up transistor and a pull-down transistor with respect to each of the K sense lines SENL and may include a control circuit for controlling a gate node (Q node) of the pull-up transistor and a gate node (QB node) of the pull-down transistor.

In order to generate and output the K emission control signals EM to the K emission control lines EML, the emission control driver EMD provided in each block unit may include a pull-up transistor and a pull-down transistor with respect to each of the K emission control lines EML and may include a control circuit for controlling a gate node (Q node) of the pull-up transistor and a gate node (QB node) of the pull-down transistor.

The scan driver SCD and the sense driver SED may be implemented together.

Hereinafter, for convenience of description, an example of a case in which each of the M blocks BLK #1 to BLK #M includes six subpixel lines SPL #1 to SPL #6 (N=6) will be described. Among the M blocks BLK #1 to BLK #M, examples of the first block BLK #1 and the second block BLK #2 will be described.

Figure 8:
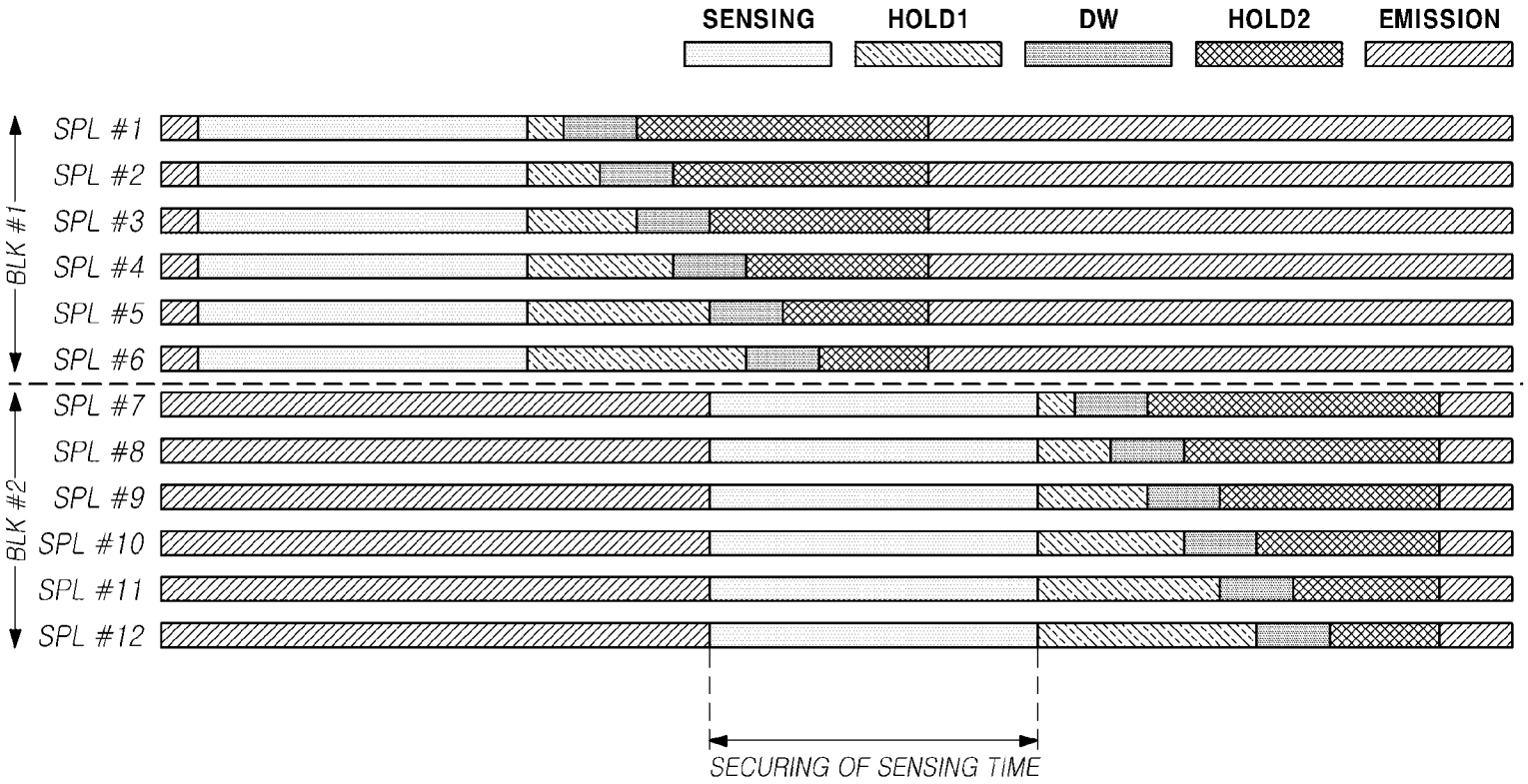
FIG. 8 is a timing diagram of block driving according to a first method of the light-emitting display device according to aspects of the present disclosure.
Figure 9:
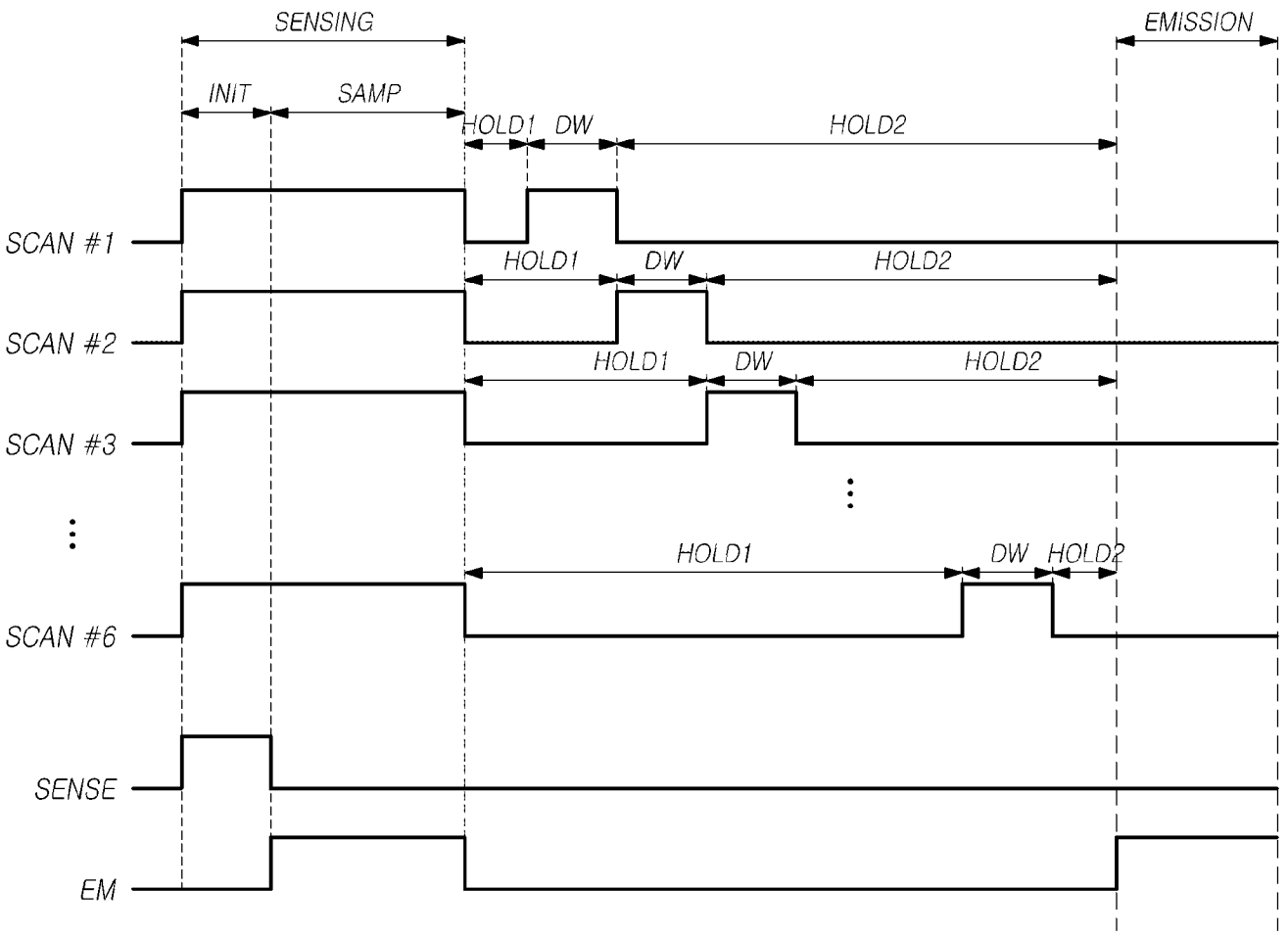
FIG. 9 is a diagram illustrating gate signals applied to one block in the block driving according to the first method of the light-emitting display device in the present disclosure.

FIG. 8 is a timing diagram of block driving according to a first method of the light-emitting display device 100 according to aspects of the present disclosure, and FIG. 9 is a diagram illustrating gate signals SCAN, SENSE, and EM applied to a first block BLK #1 in the block driving according to the first method of the light-emitting display device 100 according to aspects of the pre sent disclosure.

Referring to FIGS. 8 and 9, during the block driving according to the first method, six subpixel lines SPL #1 to SPL #6 included in the first block BLK #1 are driven according to a set procedure (SENSING, HOLD1, DW, HOLD2, and EMISSION). After the driving of the six subpixel lines SPL #1 to SPL #6 included in the first block BLK #1 starts, driving of six subpixel lines SPL #1 to SPL #6 included in a second block BLK #2 may start.

As an example, driving times of the first block BLK #1 and the second block BLK #2 may be controlled so that driving of six scan lines SCL corresponding to the six subpixel lines SPL #1 to SPL #6 included in the first block BLK #1 does not overlap driving of six scan lines SCL corresponding to the six subpixel lines SPL #1 to SPL #6 included in the second block BLK #2.

Referring to FIGS. 8 and 9, in the block driving according to the first method, in the case of subpixels SP disposed in the six subpixel lines SPL #1 to SPL #6 included in the first block BLK #1, sensing periods SENSING and emission periods EMISSION proceed concurrently, and data writing periods DW proceed sequentially.

Referring to FIGS. 8 and 9, in the block driving according to the first method, during an initialization period NIT in the sensing period SENSING, the gate driving circuit 130 concurrently applies scan signals SCAN #1 to SCAN #6 having a turn-on level voltage to the six scan lines SCL corresponding to the six subpixel lines SPL #1 to SPL #6 included in the first block BLK #1, concurrently applies sense signals SENSE having a turn-on level voltage to K scan lines SCL (1<K<6) corresponding to the six subpixel lines SPL #1 to SPL #6 included in the first block BLK #1, and concurrently applies emission control signals EM having a turn-off level voltage to K emission control lines EML (1<K<6) corresponding to the six subpixel lines SPL #1 to SPL #6 included in the first block BLK #1.

Referring to FIGS. 8 and 9, in the block driving according to the first method, during a sampling period SAMP in the sensing period SENSING; the gate driving circuit 130 concurrently and continuously applies the scan signals SCAN #1 to SCAN #6 having a turn-on level voltage to the six scan lines SCL corresponding to the six subpixel lines SPL #1 to SPL #6 included in the first block BLK #1, concurrently applies the sense signals SENSE having a turn-off level voltage to the K scan lines SCL (1<K<6) corresponding to the six subpixel lines SPL #1 to SPL #6 included in the first block BLK #1, and concurrently applies the emission control signals EM having a turn-on level voltage to the K emission control lines EML (1<K<6) corresponding to the six subpixel lines SPL #1 to SPL #6 included in the first block BLK #1.

As described above, all of the six subpixel lines SPL #1 to SPL #6 concurrently receive the sense signals SENSE having a turn-on level voltage or a turn-off level voltage.

As an example of a supply structure of the sense signal SENSE, each of the subpixels SP disposed in the six subpixel lines SPL #1 to SPL #6 included in the first block BLK #1 includes one sense transistor SENT. In this case, six sense lines SENL corresponding to the six subpixel lines SPL #1 to SPL #6 included in the first block BLK #1 may be disposed, and the gate driving circuit 130 may supply the sense signals SENSE having a turn-on level voltage or a turn-off level voltage to the six sense lines SENL. As an example of a supplying method of the sense signal SENSE with respect to the first block BLK #1, the gate driving circuit 130 may output six sense signals SENSE. The six sense signals SENSE output from the gate driving circuit 130 may be applied to the six sense lines SENL. As another example of a supplying method of the sense signal SENSE with respect to the first block BLK #1, the gate driving circuit 130 may output one sense signal SENSE. In this case, one sense signal SENSE may be branched and supplied to the six sense lines SENL.

As another example of a supply structure of the sense signal SENSE, the subpixels SP disposed in the six subpixel lines SPL #1 to SPL #6 included in the first block BLK #1 may share one sense transistor SENT in a unit of a column (that is, K=1). In this case, one sense line SENL corresponding to the six subpixel lines SPL #1 to SPL #6 included in the first block BLK #1 may be disposed, and the gate driving circuit 130 may supply a sense signal SENSE having a turn-on level voltage or a turn-off level voltage to the one sense line SENL. The sense signal SENSE having a turn-on level voltage or turn-off level voltage supplied to the one sense line SENL is applied to one sense transistor SENT in a unit of a column and is shared by subpixels SP in the same column included in the six subpixel lines SPL #1 to SPL #6.

As described above, all of the six subpixel lines SPL #1 to SPL #6 concurrently receive the emission control signals EM having a turn-on level voltage or a turn-off level voltage.

As an example of a supply structure of the emission control signal EM, each of the subpixels SP disposed in the six subpixel lines SPL #1 to SPL #6 included in the first block BLK #1 may include one emission control transistor EMT. In this case, six emission control lines EML corresponding to the six subpixel lines SPL #1 to SPL #6 included in the first block BLK #1 may be disposed, and the gate driving circuit 130 may supply emission control signals EM having a turn-on level voltage or a turn-off level voltage to the six emission control lines EML. As an example of a supplying method of the emission control signal EM with respect to the first block BLK #1, the gate driving circuit 130 may output six emission control signals EM. The six emission control signals EM output from the gate driving circuit 130 may be applied to the six emission control lines EML. As another example of a supplying method of the emission control signal EM with respect to the first block BLK #1, the gate driving circuit 130 may output one emission control signal EM. One emission control signal EM may be branched and supplied to the six emission control lines EML.

As another example of a supply structure of the emission control signal EM, the subpixels SP disposed in the six subpixel lines SPL #1 to SPL #6 included in the first block BLK #1 may share one emission control transistor EMT in a unit of a column (that is, K=1). In this case, one emission control line EML corresponding to the six subpixel lines SPL #1 to SPL #6 included in the first block BLK #1 may be disposed, and the gate driving circuit 130 may supply an emission control signal EM having a turn-on level voltage or a turn-off level voltage to the one emission control line EML. The emission control signal EM having a turn-on level voltage or a turn-off level voltage supplied to the one emission control line EML is applied to one sense transistor SENT in a unit of a column and is shared by subpixels SP in the same column included in the six subpixel lines SPL #1 to SPL #6

Referring to FIGS. 8 and 9, in the block driving according to the first method, when the sensing periods SENSING start concurrently and end concurrently, data voltages Vdata for image display are sequentially applied to the subpixels SP included in the six subpixel lines SPL #1 to SPL #6 included in the first block BLK #1. That is, in the block driving according to the first method, the data writing periods DW of the six subpixel lines SPL #1 to SPL #6 included in the first block BLK #1 proceed sequentially.

To this end, the six subpixel lines SPL #1 to SPL #6 included in the first block BLK #1 have first holding periods HOLD1 having different lengths. After the first holding periods HOLD1, the six subpixel lines SPL #1 to SPL #6 have the data writing periods DW. Here, the data writing periods DW of the six subpixel lines SPL #1 to SPL #6 included in the first block BLK #1 may have the same time length.

During the first holding period HOLD1, the six subpixel lines SPL #1 to SPL #6 included in the first block BLK #1 receive the scan signals SCAN #1 to SCAN #6 having a turn-off level voltage, the sense signals SENSE having a turn-off level voltage, and the emission control signals EM having a turn-off level voltage.

Referring to FIGS. 8 and 9, since the data writing periods DW of the six subpixel lines SPL #1 to SPL #6 included in the first block BLK #1 proceed sequentially, the six subpixel lines SPL #1 to SPL #6 included in first block BLK #1 have second holding periods HOLD2 having different lengths. Thereafter, the emission periods EMISSION of the six subpixel lines SPL #1 to SPL #6 included in the first block BLK #1 proceed concurrently. Here, the emission periods EMISSION of the six subpixel lines SPL #1 to SPL #6 included in the first block BLK #1 may have the same time length.

Figure 10:
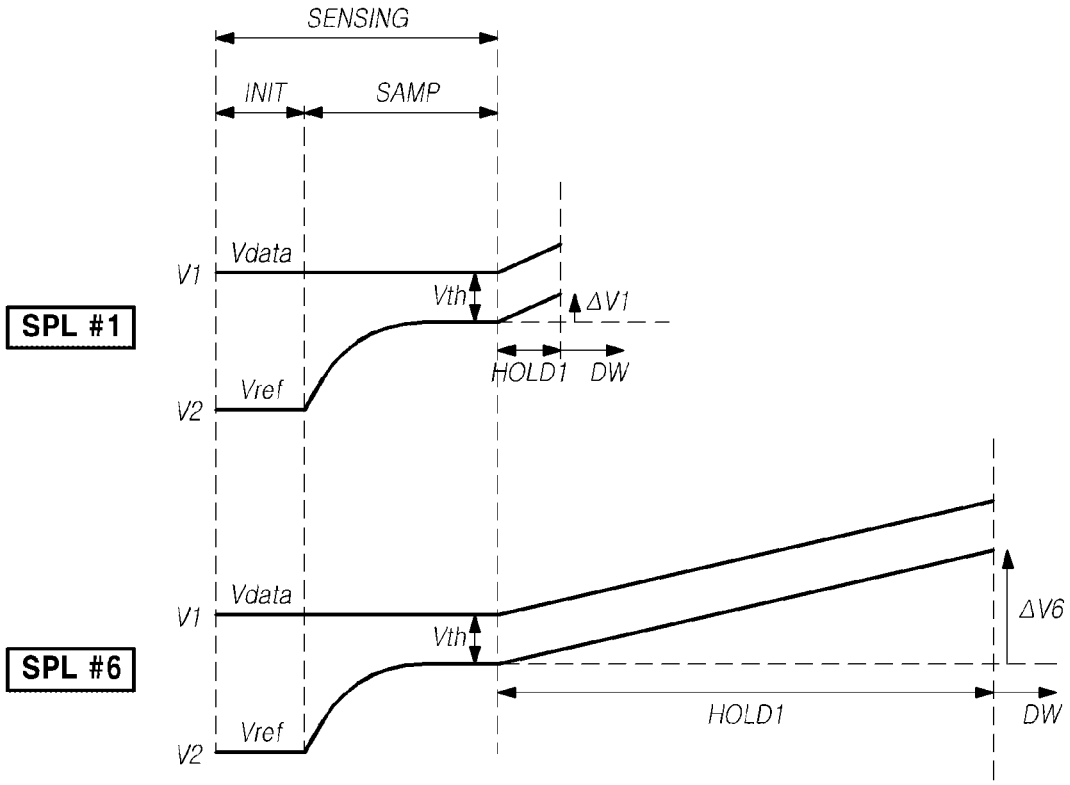
FIG. 10 is a diagram illustrating changes in voltages of a first node and a second node of a driving transistor in a subpixel disposed in each of a first subpixel line and a last subpixel line in one block during a sensing period and a first holding period in the block driving according to the first method of the light-emitting display device in the present disclosure.
Figure 11:
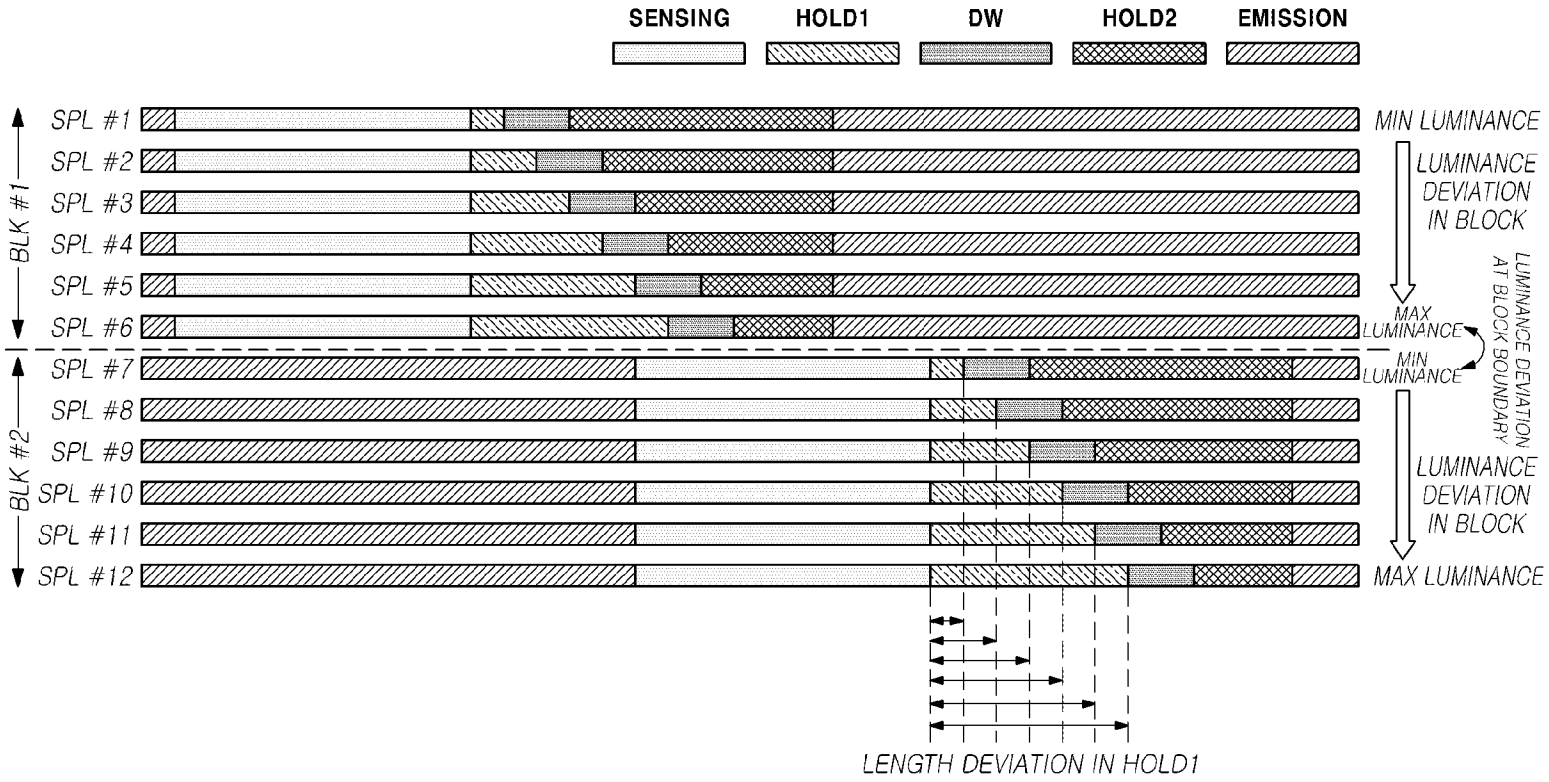
FIG. 11 is a diagram for describing luminance non-uniformity in the block driving according to the first method of the light-emitting display device in the present disclosure.

FIG. 10 is a diagram illustrating changes in voltages of a first node N1 and a second node N2 of a driving transistor DRT in a subpixel SP disposed in each of a first subpixel line SPL #1 and a last (sixth) subpixel line SPL #6 in one block during the sensing period SENSING and the first holding period HOLD1 in the block driving according to the first method of the light-emitting display device 100 according to aspects of the present disclosure. FIG. 11 is a diagram for describing luminance non-uniformity in the block driving according to the first method of the light-emitting display device 100 according to aspects of the pre sent disclosure.

Referring to FIG. 10, in the block driving according to the first method, during the initialization period INIT in the sensing period SENSING in all of the subpixels SP in the first block BLK #1, a voltage V1 of the first node N1 of the driving transistor DRT is initialized to a data voltage Vdata for sensing driving, and a voltage V2 of the second node N2 of the driving transistor DRT is initialized to a reference voltage Vref.

Referring to FIG. 10, in the block driving according to the first method, during the sampling period SAMP in the sensing period SENSING in all of the subpixels SP in the first block BLK #1, in a state in which the voltage V1 of the first node N1 of the driving transistor DRT is maintained at the data voltage Vdata for sensing driving, the second node N2 of the driving transistor DRT is floated. Accordingly, the voltage V2 of the second node N2 of the driving transistor DRT rises, and when the voltage V2 differs from the voltage V1 of the first node N1 by a certain voltage Vth, the second voltage V2 stops rising and is saturated. During the sampling period SAMP in the sensing period SENSING; the saturated voltage V2 of the second node N2 of the driving transistor DRT has a voltage value (Vdata-Vth) obtained by subtracting a threshold voltage of the driving transistor DRT from the data voltage Vdata for sensing driving.

Referring to FIG. 10, in the block driving according to the first method, after the sensing period SENSING, while the first holding periods HOLD1 proceed, the first node N1 and the second node N2 of the driving transistor DRT of all the subpixels SP in the first block BLK #1 are floated. Accordingly, the voltages of the first node N1 and the second node N2 of the driving transistor DRT of all the subpixels SP in the first block BLK #1 rise during the first holding periods HOLD1.

As described with reference to FIGS. 8 and 9, in the block driving according to the first method, the first holding periods HOLD1 of the six subpixel lines SPL #1 to SPL #6 included in the first block BLK #1 have different time lengths.

Referring to the example of FIG. 10, in the block driving according to the first method, among the six subpixel lines SPL #1 to SPL #6 included in the first block BLK #1, the first holding period HOLD1 of the first subpixel line SPL #1 is shorter than the first holding period HOLD1 of the last subpixel line SPL #6.

Accordingly, among the six subpixel lines SPL #1 to SPL #6 included in the first block BLK #1, a voltage rise AV1 of the second node N2 of the driving transistor DRT during the first holding period HOLD1 of the first subpixel line SPL #1 is smaller than a voltage rise AV6 of the second node N2 of the driving transistor DRT during the first holding period HOLD1 of the last subpixel line SPL #6.

As a result, as shown in FIG. 11, among the six subpixel lines SPL #1 to SPL #6 included in the first block BLK #1, the first subpixel line SPL #1 has a minimum luminance (Min luminance), and the last subpixel line SPL #6 has a maximum luminance (Max luminance).

Referring to FIG. 11, in the six subpixel lines SPL #1 to SPL #6 included in the first block BLK #1, luminance is gradually increased in a direction from the first subpixel line SPL #1 having the shortest first holding period HOLD1 to the sixth subpixel line SPL #6 having the longest first holding period HOLD1.

Referring to FIG. 11, the last subpixel line SPL #6 of the six subpixel lines SPL #1 to SPL #6 included in the first block BLK #1 has the maximum luminance (Max luminance), and the first subpixel line SPL #1 of the six subpixel lines SPL #1 to SPL #6 included in the second block BLK #2 has the minimum luminance (Min luminance). Accordingly, a luminance deviation may occur greatly in a boundary region between the first block BLK #1 and the second block BLK #2 adjacent to each other.

Referring to FIG. 11, a luminance deviation (luminance deviation in a block) may be present between N subpixel lines SPL #1 to SPL #N disposed in each of the M blocks BLK #1 to BLK #M. A luminance deviation (luminance deviation at a block boundary) may occur greatly in a boundary region between two blocks BLK #1 and BLK #2 adjacent to each other among the M blocks BLK #1 to BLK #M.

Hereinafter, block driving methods capable of preventing the above-described luminance non-uniformity (luminance deviation in a block and luminance deviation at a block boundary) will be described. However, in the following description, different contents from the block driving according to the first method will be mainly described, and the same contents will be omitted.

Hereinafter, a block driving method according to a second method will be described with reference to FIGS. 12 and 13, and a block driving method according to a third method will be described with reference to FIGS. 14 and 15.

Figure 12:
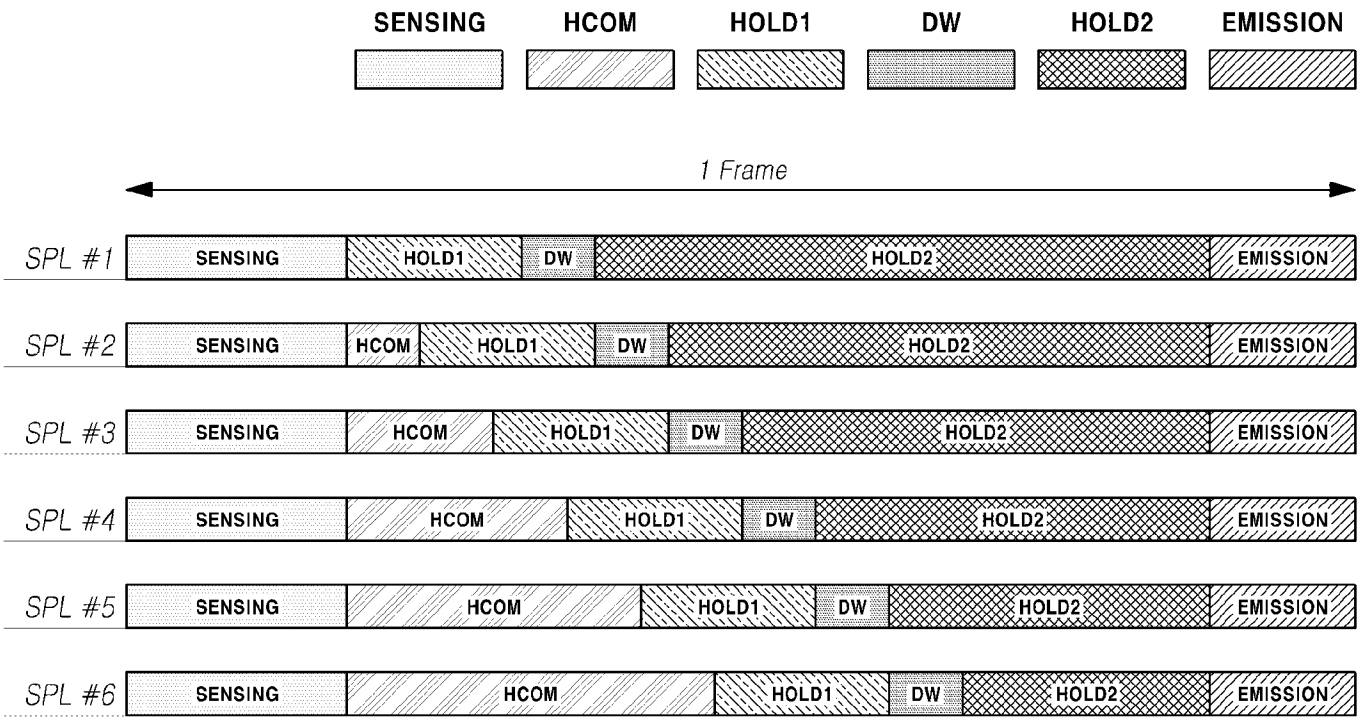
FIG. 12 is a timing diagram of block driving according to a second method of the light-emitting display device in the present disclosure.
Figure 13:
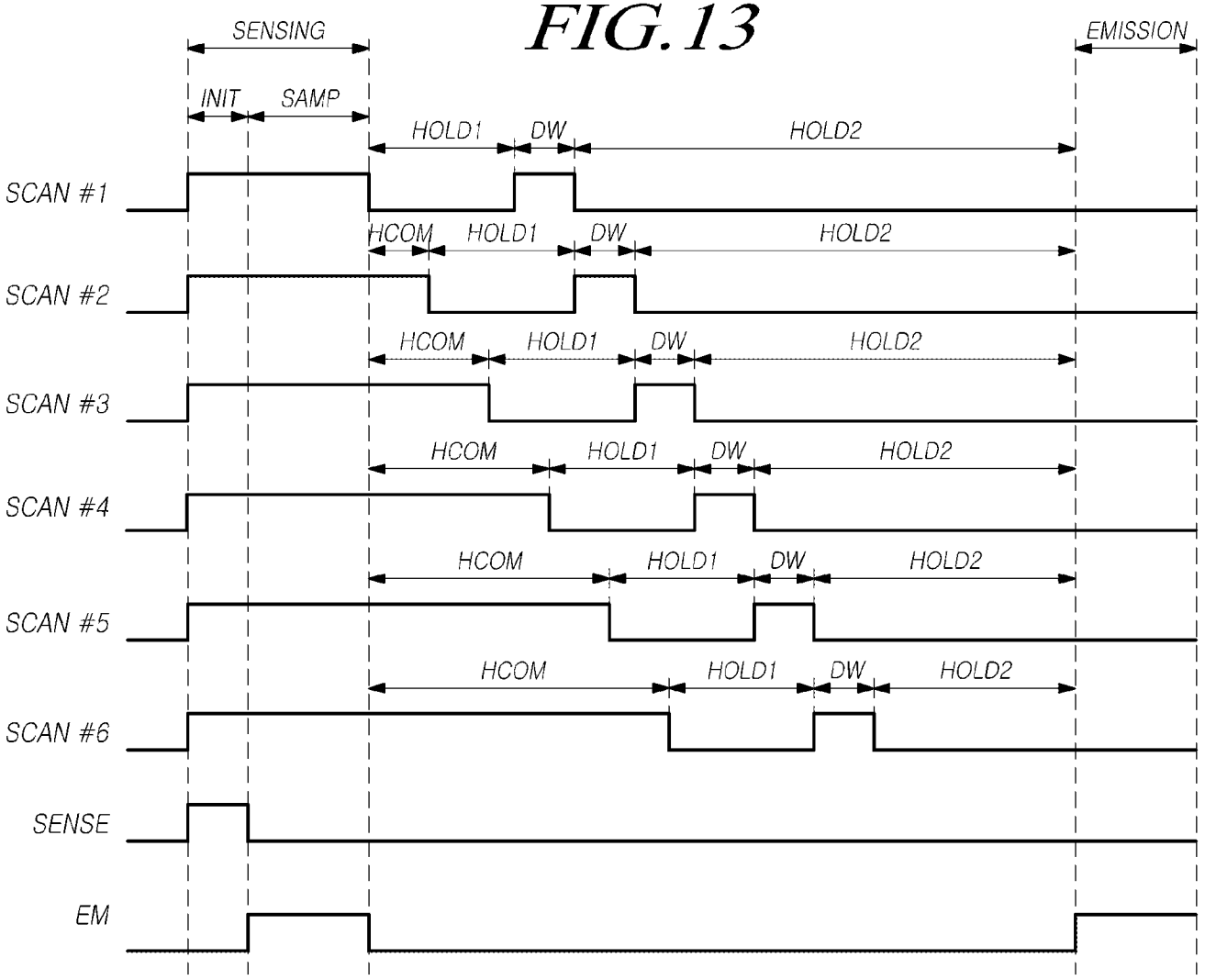
FIG. 13 is a diagram illustrating gate signals applied to one block in the block driving according to the second method of the light-emitting display device in the present disclosure.

FIG. 12 is a timing diagram of block driving according to the second method of the light-emitting display device 100 according to aspects of the present disclosure, and FIG. 13 is a diagram illustrating gate signals SCAN, SENSE, and EM applied to one block in the block driving according to the second method of the light-emitting display device 100 according to aspects of the present disclosure.

According to block driving, basically, for one frame time, subpixels SP disposed in N subpixel lines SPL #1 to SPL #N included in each of M blocks BLK #1 to BLK #M emit light concurrently.

A plurality of scan lines SCL may include N scan lines SCL corresponding to the N subpixel lines SPL #1 to SPL #N included in a first block BLK #1 of the M blocks BLK #1 to BLK #M.

Hereinafter, for convenience of description, an example of a case in which N=6 will be described.

For one frame time, the gate driving circuit 130 may concurrently supply scan signals SCAN #1 to SCAN #6 having a turn-on level voltage to six scan lines SCL during a first supply period for each of the six scan lines SCL, in which the scan signals SCAN #1 to SCAN #6 (N=6) having a turn-on level voltage are supplied first. Here, the first supply period is a period in which the scan signals SCAN #1 to SCAN #6 having a turn-on level voltage are supplied first for one frame time. As described below, in the case of the second method, the first supply period may be a period in which a sensing period SENSING and a holding deviation compensation period HCOM are combined.

For one frame time, the gate driving circuit 130 may concurrently or sequentially supply the scan signals SCAN #1 to SCAN #6 (N=6) having a turn-on level voltage to the six scan lines SCL during a second supply period for each of the six scan lines SCL, in which the scan signals SCAN #1 to SCAN #6 (N=6) having a turn-on level voltage are supplied second. Here, the second supply period is a period in which the scan signals SCAN #1 to SCAN #6 having a turn-on level voltage are supplied second for one frame time. In the case of the second method, the second supply period may be a data writing period DW.

For one frame time, the gate driving circuit 130 may supply the scan signals SCAN #1 to SCAN #6 having a turn-off level voltage to the six scan lines SCL during a period between the first supply period and the second supply period of the six scan lines SCL.

Time intervals of the six scan lines SCL between the first supply period and the second supply period may be the same. Even when the time intervals of the six scan lines SCL between the first supply period and the second supply period are different, the time intervals may be different from each other within a preset range. Here, in the case of the second method, the time interval between the first supply period and the second supply period may be a first holding period HOLD1.

As an example, as shown in FIGS. 12 and 13, the first supply periods of the six scan lines SCL may start concurrently and end sequentially. The second supply periods of the six scan lines SCL may start sequentially and end sequentially.

The first supply periods of the six scan lines SCL start concurrently and end sequentially, and thus, the first supply periods of the six scan lines SCL have different time lengths. Accordingly, the first holding periods HOLD1 of the six scan lines SCL may be the same, thereby preventing the above-described luminance non-uniformity.

Since the first supply period of one frame time for each of the six scan lines SCL includes the sensing period SENSING, during the first supply period for each of the six scan lines SCL included in the first block BLK #1, a voltage difference between two ends of each of storage capacitors Cst may be changed according to a threshold voltage Vth of each of driving transistors DRT included in subpixels SP disposed in the six subpixel lines SPL #1 to SPL #6 included in the first block BLK #1.

Hereinafter, the block driving according to the second method will be described in more detail with reference to FIGS. 12 and 13.

Referring to FIGS. 12 and 13, for one frame time, a driving time of each of the six subpixel lines SPL #1 to SPL #6 included in the first block BLK #1 may include the sensing period SENSING in which the scan signals SCAN #1 to SCAN #6 having a turn-on level voltage are supplied to the six scan lines SCL, the first holding period HOLD1 in which the scan signals SCAN #1 to SCAN #6 having a turn-off level voltage are supplied to the six scan lines SCL, the data writing period DW in which the scan signals SCAN #1 to SCAN #6 having a turn-on level voltage are supplied to the six scan lines SCL, a second holding period HOLD2 in which the scan signals SCAN #1 to SCAN #6 having a turn-off level voltage are supplied to the six scan lines SCL, and an emission period EMISSION in which light-emitting elements ED included in the subpixels SP disposed in the six subpixel lines SPL #1 to SPL #6 included in the first block BLK #1 emit light concurrently.

The first holding periods HOLD1 corresponding to the six subpixel lines SPL #1 to SPL #6 may have the same time length. Accordingly, luminance non-uniformity (luminance deviation in a block and luminance deviation at a block boundary) of the display panel 110 may be reduced or prevented.

K sense lines SENL for supplying sense signals SENSE to the subpixels SP disposed in the six subpixel lines SPL #1 to SPL #6 and K emission control lines EML for supplying emission control signals EM to the subpixels SP disposed in the six subpixel lines SPL #1 to SPL #6 may be disposed in each of the M blocks BLK #1 to BLK #M. Here, K may be one or more and N or less (i.e., $1 \leq K \leq N$).

For example, when K=N, N scan lines SCL, N sense lines SENL, and N emission control lines EML may be disposed in each of the M blocks BLK #1 to BLK #M. In this case, N subpixel lines SPL #1 to SPL #N may receive scan signals SCAN from the N scan lines SCL, receive sense signals SENSE from the N sense lines SENL, and receive emission control signals EM from the N emission control lines EML.

For another example, when K=1, N scan lines SCL, one sense line SENL, and one emission control line EML may be disposed in each of the M blocks BLK #1 to BLK #M. In this case, the N subpixel lines SPL #1 to SPL #N receive scan signals SCAN from the N scan lines SCL. The N subpixel lines SPL #1 to SPL #N may receive sense signals SCAN from one sense line SENL and receive emission control signals EM from one shared emission control line EML.

The sensing period SENSING includes an initialization period INIT and a sampling period SAMP.

During the first initialization period INIT and the sampling period SAMP in the sensing period SENSING; the gate driving circuit 130 supplies the scan signals SCAN #1 to SCAN #6 having a turn-on level voltage to the six scan lines SCL.

During the initialization period INIT in the sensing period SENSING; the gate driving circuit 130 may supply sense signals SENSE having a turn-on level voltage to the K sense lines SENL ($1<K<N$) disposed to correspond to the six subpixel lines SPL #1 to SPL #6 included in the first block BLK #1.

During the sampling period SAMP in the sensing period SENSING; the gate driving circuit 130 may supply the sense signals SENSE having a turn-off level voltage to the K sense lines SENL.

During the initialization period INIT in the sensing period SENSING; the gate driving circuit 130 may supply emission control signals EM having a turnoff level voltage to the K emission control lines EML disposed in the first block BLK #1.

During the sampling period SAMP in the sensing period SENSING; the gate driving circuit 130 may supply the emission control signals EM having a turn-on level voltage to the K emission control lines EML.

Supplying of scan signals, supplying of sense signals, and supplying of emission control signals after the sensing period SENSING will be described as follows.

During the first holding period HOLD1, the gate driving circuit 130 supplies the scan signals SCAN #1 to SCAN #6 having a turn-off level voltage to the six scan lines SCL.

During the data writing period DW, the gate driving circuit 130 supplies the scan signals SCAN #1 to SCAN #6 having a turn-on level voltage.

During the second holding period HOLD2 and the emission period EMISSION, the gate driving circuit 130 may supply the scan signals SCAN #1 to SCAN #6 having a turn-off level voltage.

During the first holding period HOLD1, the data writing period DW, the second holding period HOLD2, and the emission period EMISSION, the gate driving circuit 130 may continuously supply the sense signals SENSE having a turnoff level voltage.

During the first holding period HOLD1, the data writing period DW, and the second holding period HOLD2, the gate driving circuit 130 may supply the emission control signals EM having a turn-off level voltage to the K emission control lines EML.

During the emission period EMISSION, the gate driving circuit 130 may supply the emission control signals EM having a turn-on level voltage to the K emission control lines EML.

Referring to FIGS. 12 and 13, for one frame time, the sensing periods SENSING of the six subpixel lines SPL #1 to SPL #6 start concurrently.

Referring to FIGS. 12 and 13, for one frame time, the first holding periods HOLD1 of the six subpixel lines SPL #1 to SPL #6 start sequentially, and the data writing periods DW of the six subpixel lines SPL #1 to SPL #6 start sequentially. Thus, it is possible to remove a length deviation between the first holding periods HOLD1 of the six subpixel lines SPL #1 to SPL #6 in the first block BLK #1. Therefore, luminance non-uniformity may be prevented.

Referring to FIGS. 12 and 13, for one frame time, the second holding periods HOLD2 of the six subpixel lines SPL #1 to SPL #6 may start sequentially, and the emission periods EMISSION of the six subpixel lines SPL #1 to SPL #6 may start concurrently.

Referring to FIGS. 12 and 13, for one frame time, the driving time of each of the six subpixel lines SPL #1 to SPL #6 may further include the holding deviation compensation period HCOM that proceeds between the sensing period SENSING and the first holding period HOLD1.

The holding deviation compensation period HCOM may be a period for making time lengths of the first holding periods HOLD1 of the six subpixel lines SPL #1 to SPL #6 the same and may be a period in which the turn-on level voltage of the scan signal SCAN is maintained during the sensing period SENSING In the case of the second method, taking into account the holding deviation compensation period HCOM of each of the six subpixel lines SPL #1 to SPL #6, for one frame time, the first supply period in which the scan signals SCAN #1 to SCAN #6 having a turn-on level voltage are supplied first may be a period in which the sensing period SENSING and the holding deviation compensation period HCOM are combined. For one frame time, the second supply period may be the data writing period DW in which the scan signals SCAN #1 to SCAN #6 having a turn-on level voltage are supplied second.

Instead of removing the length deviation between the first holding periods HOLD1 of the six subpixel lines SPL #1 to SPL #6 in the first block BLK #1, the holding deviation compensation period HCOM may be provided in each of the six subpixel lines SPL #1 to SPL #6 in the first block BLK #1 to allow the data writing periods DW of the six subpixel lines SPL #1 to SPL #6 to start sequentially.

Referring to FIGS. 12 and 13, a time length of the holding deviation compensation period HCOM may be zero or more. For example, among the six subpixel lines SPL #1 to SPL #6, a time length of the holding deviation compensation period HCOM of a first subpixel line SPL #1 may be zero, and a time length of the holding deviation compensation period HCOM may be gradually increased in a direction from a second subpixel line SPL #2 to a last subpixel line SPL #6.

Referring to FIGS. 12 and 13, in each of the six subpixel lines SPL #1 to SPL #6, for one frame time, the first supply period in which the scan signals SCAN #1 to SCAN #6 having a turn-on level voltage are supplied first may be a period including the sensing period SENSING and the holding deviation compensation period HCOM.

Referring to FIGS. 12 and 13, in each of the six subpixel lines SPL #1 to SPL #6, for one frame time, the second supply period in which the scan signals SCAN #1 to SCAN #6 having a turn-on level voltage are supplied second may be the data writing period DW.

During the sensing period SENSING; the gate driving circuit 130 may concurrently supply the scan signals SCAN #1 to SCAN #6 having a turn-on level voltage to the six scan lines SCL. In addition, during the holding deviation compensation period HCOM, the gate driving circuit 130 may maintain and supply the scan signals SCAN #1 to SCAN #6 having a turn-on level voltage supplied to the six scan lines SCL during the sensing period SENSING.

In relation to the holding deviation compensation period HCOM, all of the six scan lines SCL may have the holding deviation compensation periods HCOM having different time lengths. Alternatively, excluding one scan line SCL of the six scan lines SCL, only the remaining five scan lines SCL may have the holding deviation compensation periods HCOM having different time lengths. Among the six scan lines SCL, a scan line SCL having no holding deviation compensation period HCOM may be a first scan line SCL of the six scan lines SCL corresponding to the first subpixel line SPL #1. When the holding deviation compensation period HCOM is absent, a time length of the holding deviation compensation period HCOM may be considered to be zero.

Thereafter, during the first holding period HOLD1, the gate driving circuit 130 may sequentially supply the scan signals SCAN #1 to SCAN #6 having a turn-off level voltage to the six scan lines SCL.

During the initialization period INIT in the sensing period SENSING the gate driving circuit 130 may concurrently supply the sense signals SENSE having a turn-on level voltage to the K sense lines SENL. In addition, during the sampling period SAMP in the sensing period SENSING the gate driving circuit 130 may concurrently supply the sense signals SENSE having a turn-off level voltage to the K sense lines SENL. During the holding deviation compensation period HCOM, the gate driving circuit 130 may concurrently supply the sense signals SENSE having a turn-off level voltage to the K sense lines SENL. Next, during the first holding period HOLD1, the gate driving circuit 130 may concurrently supply the sense signals SENSE having a turn-off level voltage to the K sense lines SENL.

During the initialization period INIT in the sensing period SENSING; the gate driving circuit 130 may concurrently supply the emission control signals EM having a turn-off level voltage to the K emission control lines EML. In addition, during the sampling period SAMP in the sensing period SENSING, the gate driving circuit 130 may concurrently supply the emission control signals EM having a turn-on level voltage to the K emission control lines EML. Then, during the holding deviation compensation period HCOM, the gate driving circuit 130 may concurrently supply the emission control signals EM having a turn-off level voltage, and during the first holding period HOLD1, the gate driving circuit 130 may concurrently supply the emission control signals EM having a turn-off level voltage.

The holding deviation compensation periods HCOM of the six subpixel lines SPL #1 to SPL #6 included in the first block BLK #1 may start concurrently and end sequentially, and the holding deviation compensation periods HCOM of the six subpixel lines SPL #1 to SPL #6 may have different time lengths.

For example, for each of the six subpixel lines SPL #1 to SPL #6, as an interval between the sensing period SENSING and the data writing period DW becomes longer, the holding deviation compensation period HCOM may become longer. Accordingly, the first holding periods HOLD1 of the six subpixel lines SPL #1 to SPL #6 may be substantially the same. Accordingly, voltage rise amounts of the second nodes N2 of the driving transistors DRT in the six subpixel lines SPL #1 to SPL #6 may be substantially the same.

For one frame time, a time point at which the scan signals SCAN #1 to SCAN #6 having a turn-on level voltage are supplied to the six scan lines SCL corresponding to the first block BLK #1 may be different from a time point at which the scan signals SCAN #1 to SCAN #6 having a turn-on level voltage are supplied to six scan lines SCL corresponding to a second block different from the first block BLK #1.

For one frame time, a time point at which the subpixels SP included in the six subpixel lines SPL #1 to SPL #6 included in the first block BLK #1 emit light concurrently may be different from a time point at which subpixels SP included in the six subpixel lines SPL #1 to SPL #6 included in the second block emit light concurrently.

Figure 14:
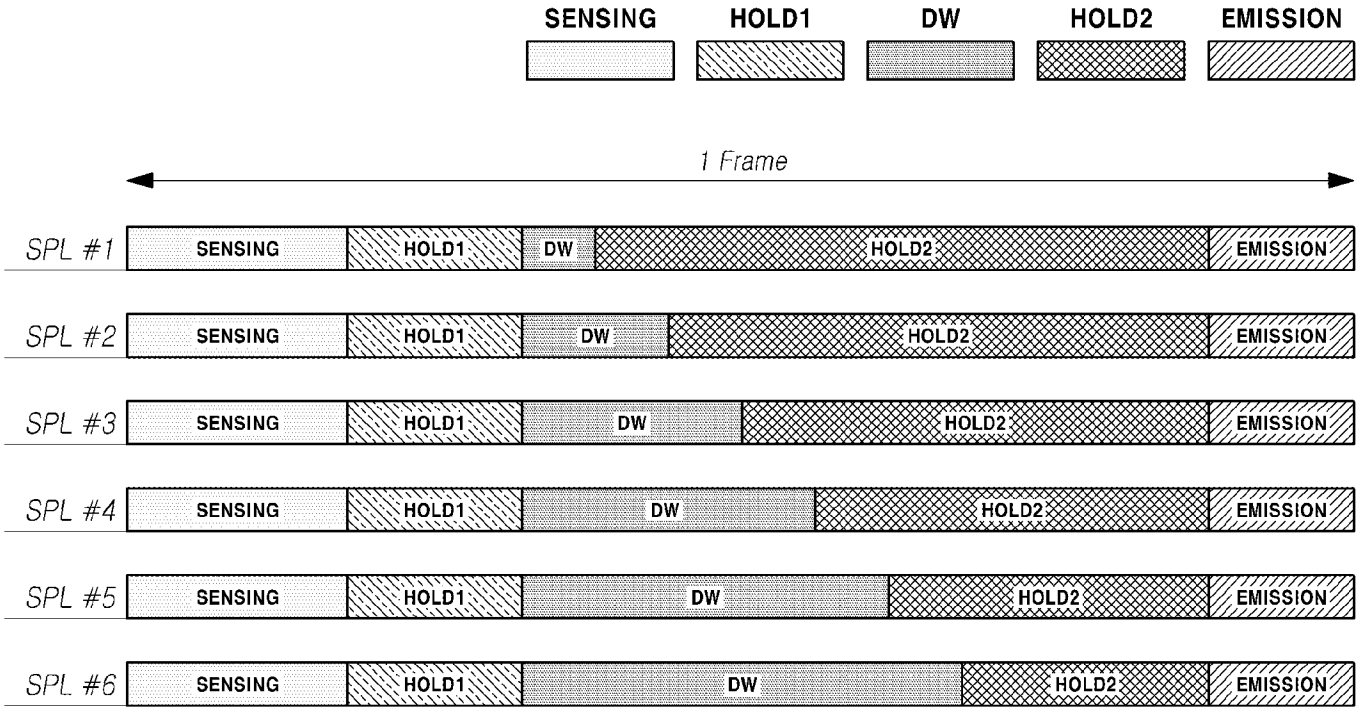
FIG. 14 is a timing diagram of block driving according to a third method of the light-emitting display device in the present disclosure.
Figure 15:
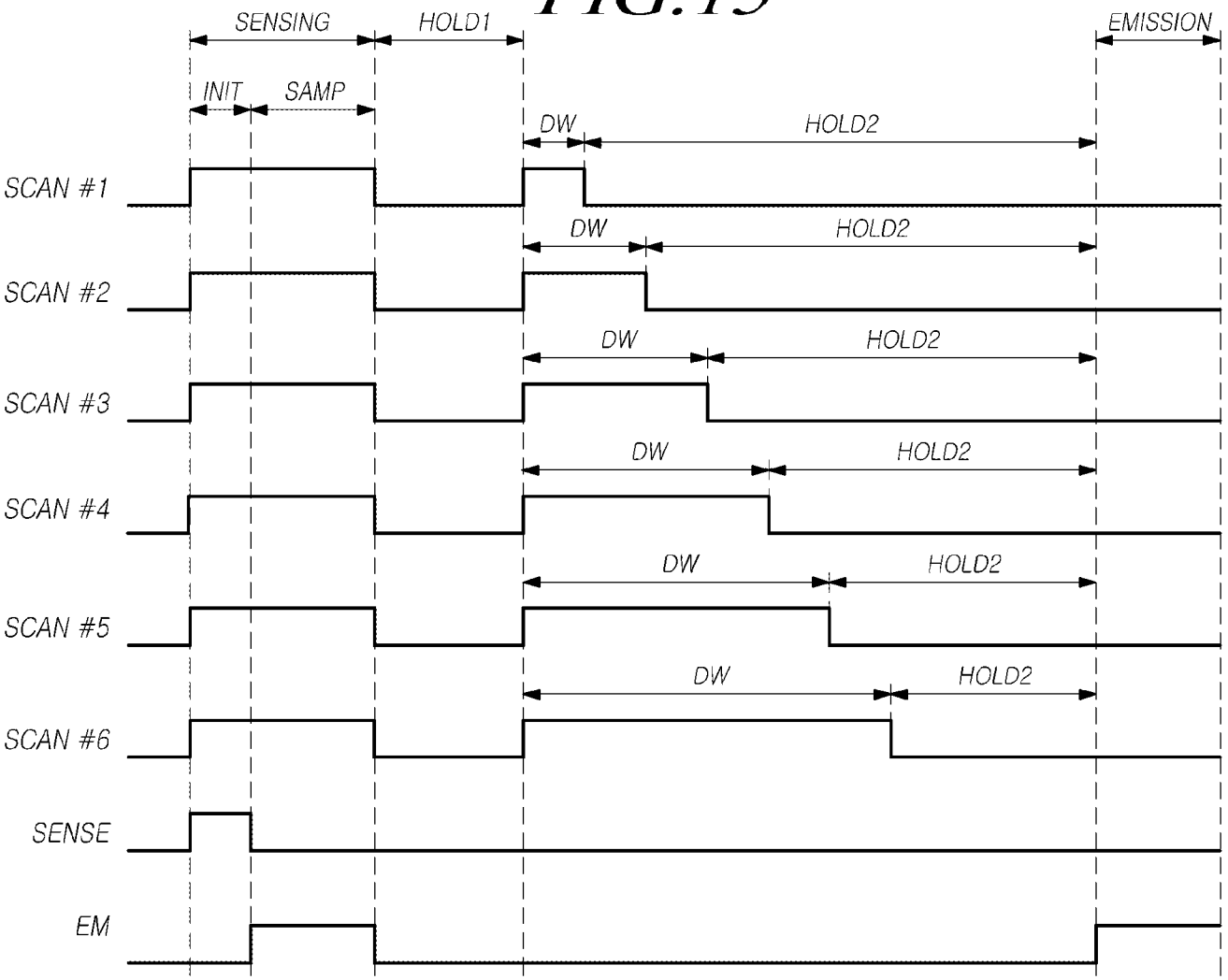
FIG. 15 is a diagram illustrating gate signals applied to one block in the block driving according to the third method of the light-emitting display device in the present disclosure.

FIG. 14 is a timing diagram of block driving according to a third method of the light-emitting display device 100 according to aspects of the present disclosure, and FIG. 15 is a diagram illustrating gate signals SCAN, SENSE, and EM applied to one block in the block driving according to the third method of the light-emitting display device 100 according to aspects of the present disclosure.

Referring to FIGS. 14 and 15, for one frame time, the gate driving circuit 130 may concurrently supply scan signals SCAN #1 to SCAN #6 having a turn-on level voltage to six scan lines SCL during a first supply period for each of the six scan lines SCL, in which the scan signals SCAN #1 to SCAN #6 (N=6) having a turn-on level voltage are supplied first. Here, the first supply period is a period in which the scan signals SCAN #1 to SCAN #6 having a turn-on level voltage are supplied first for one frame time. According to the third method, the first supply period may correspond to a sensing period SENSING Referring to FIGS. 14 and 15, for one frame time, the gate driving circuit 130 may concurrently or sequentially supply the scan signals SCAN #1 to SCAN #6 (N=6) having a turn-on level voltage to the six scan lines SCL during a second supply period for each of the six scan lines SCL, in which the scan signals SCAN #1 to SCAN #6 (N=6) having a turn-on level voltage are supplied second. Here, the second supply period is a period in which the scan signals SCAN #1 to SCAN #6 having a turn-on level voltage are supplied second for one frame time. According to the third method, the second supply period may correspond to a data writing period DW.

Referring to FIGS. 14 and 15, the gate driving circuit 130 may supply the scan signals SCAN #1 to SCAN #6 having a turn-off level voltage to the six scan lines SCL during a period between the first supply period and the second supply period for each of the six scan lines SCL. According to the third method, the period between the first supply period and the second supply period may correspond to a first holding period HOLD1 between the sensing period SENSING and the data writing period DW.

Referring to FIGS. 14 and 15, for one frame time, time intervals of the six scan lines SCL between the first supply period and the second supply period may be the same. For one frame time, although the time intervals of the six scan lines SCL between the first supply period and the second supply period are different, the time intervals may be different from each other within a preset range. Here, the time interval between the first supply period and the second supply period may be the first holding period HOLD1.

Referring to FIGS. 14 and 15, the first supply periods of the six scan lines SCL may start concurrently and end concurrently, and the second supply period of the six scan lines SCL may start concurrently and end sequentially.

As described above, for one frame time, a length deviation between the first holding periods HOLD1 of the six scan lines SCL may be removed to prevent luminance non-uniformity.

Since the first supply period of one frame time for each of the six scan lines SCL includes the sensing period SENSING, during the first supply period for each of the six scan lines SCL included in a first block BLK #1, a voltage difference between two ends of each of storage capacitors Cst may be changed according to a threshold voltage Vth of each of driving transistors DRT included in subpixels SP disposed in six subpixel lines SPL #1 to SPL #6 included in the first block BLK #1.

For one frame time, a driving time of each of the six subpixel lines SPL #1 to SPL #6 included in the first block BLK #1 may include the sensing period SENSING in which the scan signals SCAN #1 to SCAN #6 having a turn-on level voltage are supplied to the six scan lines SCL, the first holding period HOLD1 in which the scan signals SCAN #1 to SCAN #6 having a turn-off level voltage are supplied to the six scan lines SCL, the data writing period DW in which the scan signals SCAN #1 to SCAN #6 having a turn-on level voltage are supplied to the six scan lines SCL, a second holding period HOLD2 in which the scan signals SCAN #1 to SCAN #6 having a turn-off level voltage are supplied to the six scan lines SCL, and an emission period EMISSION in which light-emitting elements ED included in the subpixels SP disposed in the six subpixel lines SPL #1 to SPL #6 included in the first block BLK #1 emit light concurrently.

The first holding periods HOLD1 corresponding to the six subpixel lines SPL #1 to SPL #6 may have the same time length.

Referring to FIGS. 14 and 15, for one frame time, the sensing periods SENSING of the six subpixel lines SPL #1 to SPL #6 start concurrently. The first holding periods HOLD1 of the six subpixel lines SPL #1 to SPL #6 start concurrently and end concurrently. The data writing periods DW of the six subpixel lines SPL #1 to SPL #6 may start concurrently and end sequentially. The second holding periods HOLD2 of the six subpixel lines SPL #1 to SPL #6 start sequentially and end concurrently. The emission periods EMISSION of the six subpixel lines SPL #1 to SPL #6 may start concurrently.

Referring to FIGS. 14 and 15, for each of the six subpixel lines SPL #1 to SPL #6, the first supply period may be the sensing period SENSING; and the second supply period may be the data writing period DW.

Referring to FIGS. 14 and 15, the gate driving circuit 130 may concurrently supply the scan signals SCAN #1 to SCAN #6 having a turn-on level voltage to the six scan lines SCL during the sensing period SENSING, concurrently supply the scan signals SCAN #1 to SCAN #6 having a turn-off level voltage during the first holding period HOLD1, concurrently supply the scan signals SCAN #1 to SCAN #6 having a turn-on level voltage during the data writing period DW, sequentially supply the scan signals SCAN #1 to SCAN #6 having a turn-off level voltage during the second holding period HOLD2, and continuously supply the scan signals SCAN #1 to SCAN #6 having a turn-off level voltage during the emission period EMISSION.

Referring to FIGS. 14 and 15, the gate driving circuit 130 may concurrently supply sense signals SENSE having a turn-on level voltage to K sense lines SENL during an initialization period NIT in the sensing period SENSING; concurrently supply the sense signals SENSE having a turn-off level voltage to the K sense lines SENL during a sampling period SAMP in the sensing period SENSING; and continuously supply the sense signals SENSE having a turn-off level voltage to the K sense lines SENL during the first holding period HOLD1, the data writing period DW, the second holding period HOLD2, and the emission period EMISSION.

Referring to FIGS. 14 and 15, the gate driving circuit 130 may concurrently supply emission control signals EM having a turn-off level voltage to K emission control lines EML during the initialization period INIT in the sensing period SENSING; concurrently supply the emission control signals EM having a turn-on level voltage to the K emission control lines EML during the sampling period SAMP in the sensing period SENSING, continuously supply the emission control signals EM having a turn-off level voltage to the K emission control lines EML during the first holding period HOLD1, the data writing period DW, and the second holding period HOLD2, and concurrently supply the emission control signals EM having a turn-on level voltage to the K emission control lines EML during the emission period EMISSION.

Referring to FIGS. 14 and 15, according to the block driving of the third method, the first holding periods HOLD1 of the six subpixel lines SPL #1 to SPL #6 may start concurrently, and the data writing periods DW of the six subpixel lines SPL #1 to SPL #6 may start concurrently and end sequentially. Accordingly, the data writing periods DW of the six subpixel lines SPL #1 to SPL #6 may have different time lengths. For example, in the first block BLK #1, the data writing period DW may be gradually increased in a direction from a first subpixel line SPL #1 to a last subpixel line SPL #6. That is, among the six subpixel lines SPL #1 to SPL #6, the data writing period DW of the first subpixel line SPL #1 may be the shortest, and the data writing period DW of the last subpixel line SPL #6 may be the longest. Therefore, a luminance deviation in a block and a luminance deviation at a block boundary may be reduced to prevent luminance non-uniformity.

For one frame time, a time point at which the scan signals SCAN #1 to SCAN #6 having a turn-on level voltage are supplied to the six scan lines SCL corresponding to the first block BLK #1 may be different from a time point at which the scan signals SCAN #1 to SCAN #6 having a turn-on level voltage are supplied to six scan lines SCL corresponding to a second block different from the first block BLK #1. A time point at which the subpixels SP included in the six subpixel lines SPL #1 to SPL #6 included in the first block BLK #1 emit light concurrently may be different from a time point at which subpixels SP included in the six subpixel lines SPL #1 to SPL #6 included in the second block emit light concurrently.

Hereinafter, the block driving method according to the second method described with reference to FIGS. 12 and 13 and the block driving method according to the third method described with reference to FIGS. 14 and 15 will be briefly described again with reference to FIG. 16.

Figure 16:
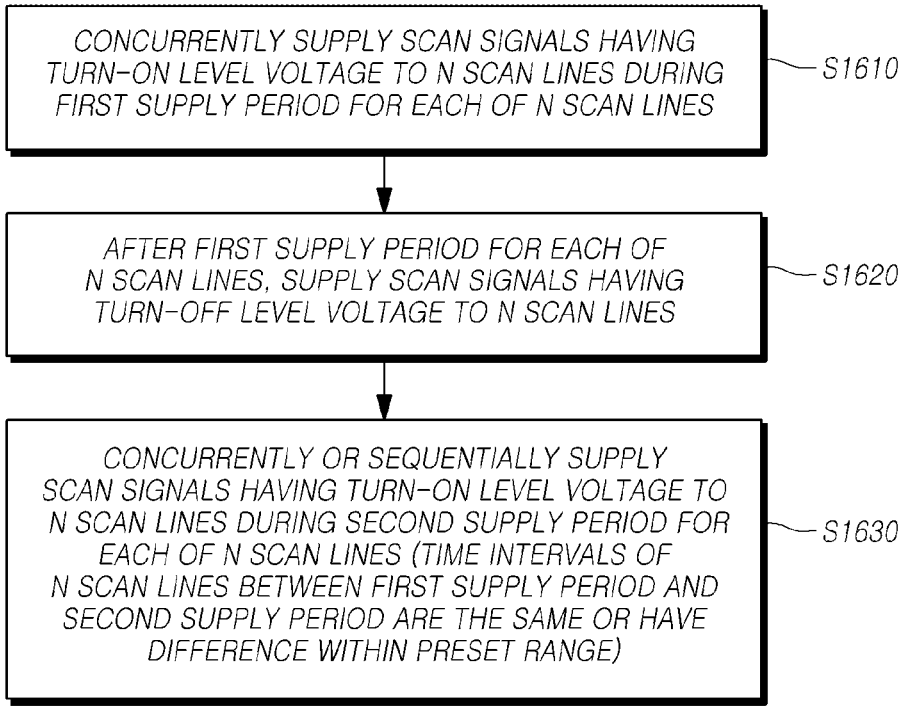
FIG. 16 is a flowchart of a method of driving a light-emitting display device according to the present disclosure.

FIG. 16 is a flowchart of a method of driving the light-emitting display device 100 according to aspects of the present disclosure.

Referring to FIG. 16, the method of driving the light-emitting display device 100 according to the aspects of the present disclosure may include concurrently supplying scan signals SCAN #1 to SCAN #6 having a turn-on level voltage to six scan lines SCL of a plurality of scan lines SCL during a first supply period for each of the six scan lines SCL, in which the scan signals SCAN #1 to SCAN #6 (N=6) having a turn-on level voltage are supplied first for one frame time (S1610), after the first supply period for each of the six scan lines SCL, supplying the scan signals SCAN #1 to SCAN #6 having a turn-off level voltage to the six scan lines SCL for one frame time (S1620), and concurrently or sequentially supplying the scan signals SCAN #1 to SCAN #6 having a turn-on level voltage to the six scan lines SCL during a second supply period for each of the six scan lines SCL, in which the scan signals SCAN #1 to SCAN #6 (N=6) having a turn-on level voltage are supplied second for one frame time (S1630).

Time intervals of the six scan lines SCL between the first supply period and the second supply period may be the same or have a difference within a preset range.

Hereinafter, a block driving method according to a fourth method will be described with reference to FIGS. 17 and 18, and a block driving method according to a fifth method will be described with reference to FIGS. 19 and 20.

Figure 17:
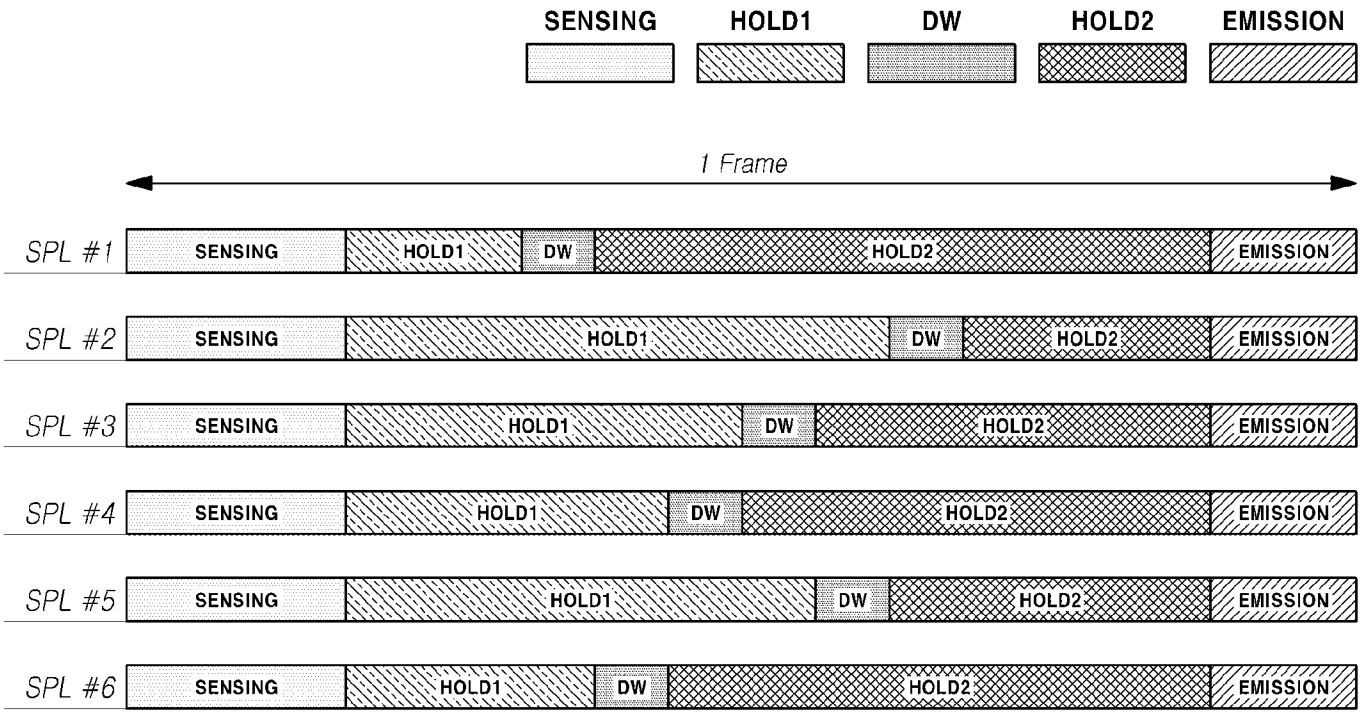
FIG. 17 is a timing diagram of block driving according to a fourth method of the light-emitting display device in the present disclosure.
Figure 18:
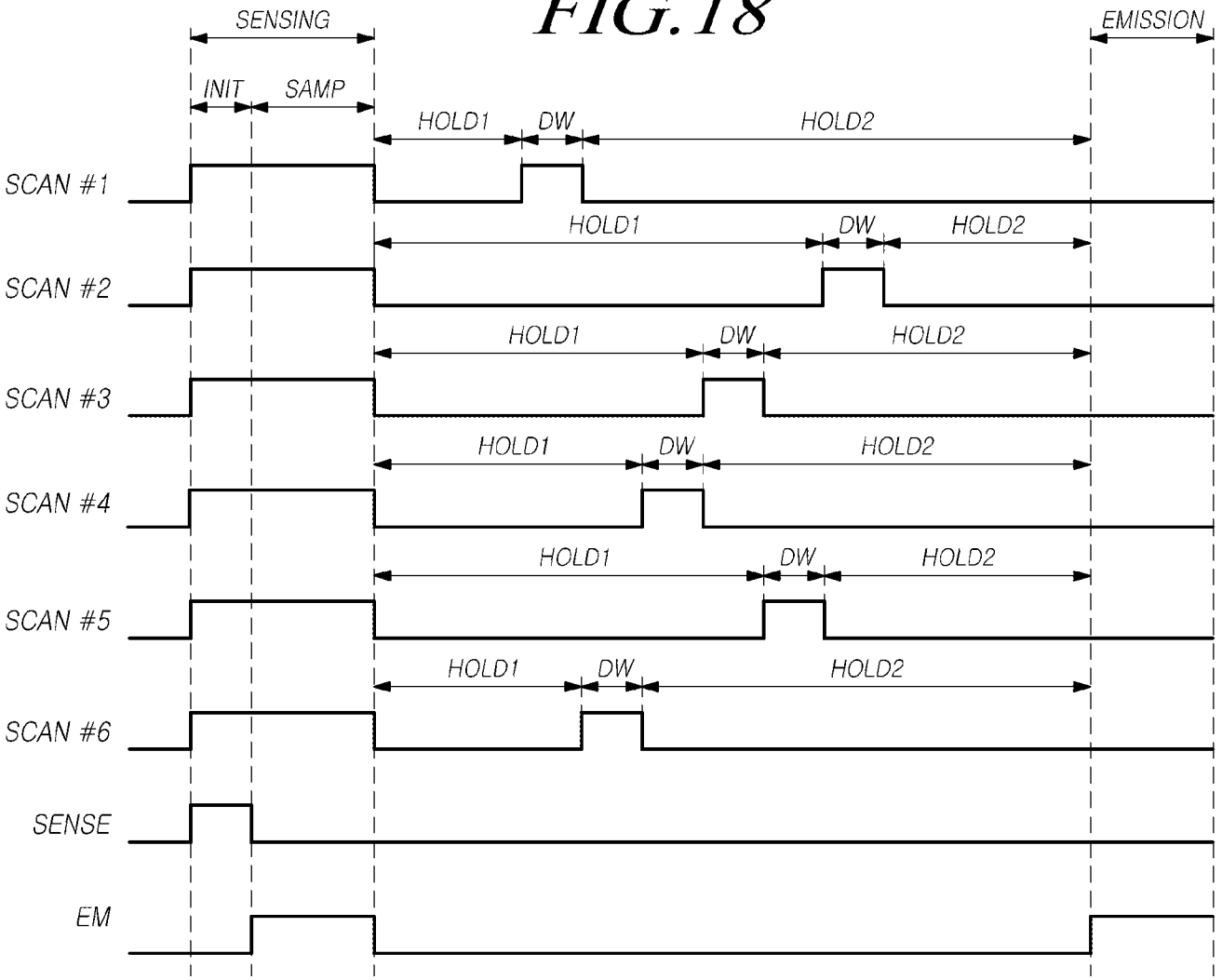
FIG. 18 is a diagram illustrating gate signals applied to one block in the block driving according to the fourth method of the light-emitting display device in the present disclosure.

FIG. 17 is a timing diagram of block driving according to the fourth method of the light-emitting display device 100 according to aspects of the present disclosure, and FIG. 18 is a diagram illustrating gate signals SCAN, SENSE, and EM applied to one block in the block driving according to the fourth method of the light-emitting display device 100 according to aspects of the present disclosure.

Referring to FIGS. 17 and 18, for one frame time, the gate driving circuit 130 may concurrently supply scan signals SCAN #1 to SCAN #6 having a turn-on level voltage to six scan lines SCL during a first supply period for each of the six scan lines SCL, in which the scan signals SCAN #1 to SCAN #6 (N=6) having a turn-on level voltage are supplied first. Here, the first supply period is a period in which the scan signals SCAN #1 to SCAN #6 having a turn-on level voltage are supplied first for one frame time. In the case of the fourth method, the first supply period may correspond to a sensing period SENSING.

Referring to FIGS. 17 and 18, for one frame time, the gate driving circuit 130 may supply the scan signals SCAN #1 to SCAN #6 having a turn-on level voltage to the six scan lines SCL during a second supply period for each of the six scan lines SCL, in which the scan signals SCAN #1 to SCAN #6 (N=6) having a turn-on level voltage are supplied second. Here, the second supply period is a period in which the scan signals SCAN #1 to SCAN #6 having a turn-on level voltage are supplied second for one frame time. In the case of the fourth method, the second supply period may be a data writing period DW.

Referring to FIGS. 17 and 18, according to the fourth method, the second supply periods of the six scan lines SCL may start non-sequentially at different time points. Alternatively, as will be described below with reference to FIGS. 19 and 20, according to the fifth method, the second supply periods of the six scan lines SCL may have different time lengths. Alternatively, data voltages Vdata supplied to subpixels SP of the six subpixel lines SPL #1 to SPL #6 during the second supply period for each of the six scan lines SCL may be different.

Referring to FIGS. 17 and 18, according to the fourth method, when the second supply periods of the six scan lines SCL start non-sequentially at different times, in a first scan line SCL and an $6^{th}$ scan line SCL of the six scan lines SCL, among the six scan lines SCL disposed to correspond to each of M blocks BLK #1 to BLK #M, a time interval between a first supply period and a second supply period of the first scan line SCL and a time interval between a first supply period and a second supply period of a last ($6^{th}$) scan line SCL may be the same or have a difference within a preset range.

Accordingly, a luminance deviation at a block boundary may be reduced or prevented. That is, a luminance deviation between a last subpixel line SPL #6 of a first block BLK #1 and a first subpixel line SPL #1 of a second block BLK #2 may be reduced or prevented.

Figure 19:
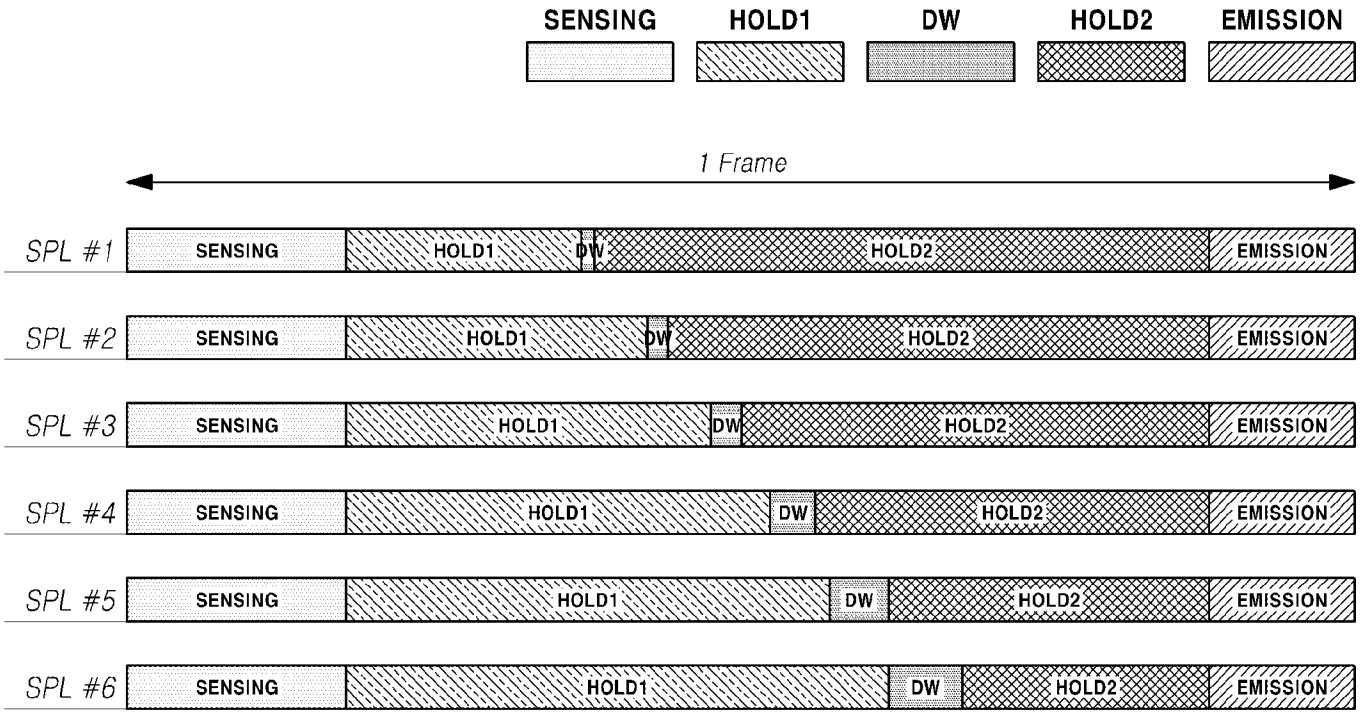
FIG. 19 is a timing diagram of block driving according to a fifth method of the light-emitting display device in the present disclosure.
Figure 20:
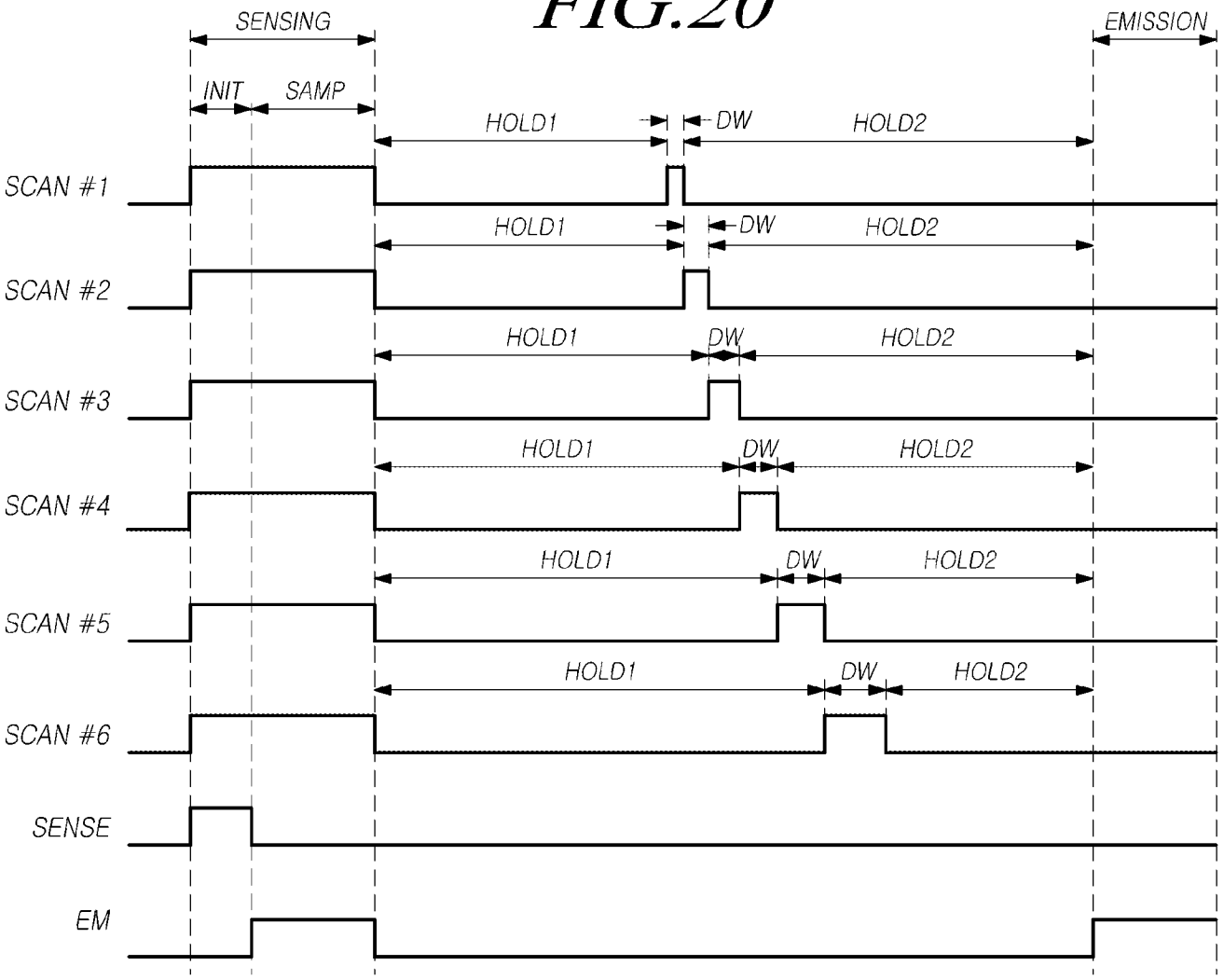
FIG. 20 is a diagram illustrating gate signals applied to one block in the block driving according to the fifth method of the light-emitting display device in the present disclosure.

FIG. 19 is a timing diagram of block driving according to the fifth method of the light-emitting display device 100 according to aspects of the present disclosure, and FIG. 20 is a diagram illustrating gate signals SCAN, SENSE, and EM applied to one block in the block driving according to the fifth method of the light-emitting display device 100 according to aspects of the present disclosure.

The light-emitting display device 100 according to the present aspects may include a display panel 110 which includes a plurality of data lines DL and a plurality of gate lines GL disposed therein and includes a plurality of subpixels SP disposed in a matrix form and each including a light-emitting element ED, a driving transistor DRT configured to control a current flowing in the light-emitting element ED, a scan transistor SCT configured to transmit a data voltage Vdata to a first node N1 of the driving transistor DRT, and a storage capacitor Cst configured to maintain a voltage for a certain time, a data driving circuit 120 which drives the plurality of data lines DL, a gate driving circuit 130 which drives the plurality of gate lines GL, and a controller 140 which controls the data driving circuit 120 and the gate driving circuit 130.

Hereinafter, for convenience of description, an example in which each of M blocks BLK #1 to BLK #M includes six subpixel lines SPL #1 to SPL #6 will be described. That is, it is assumed that N is 6.

Referring to FIGS. 19 and 20, for one frame time, the gate driving circuit 130 may concurrently supply scan signals SCAN #1 to SCAN #6 having a turn-on level voltage to six scan lines SCL during a first supply period for each of the six scan lines SCL in which the scan signals SCAN #1 to SCAN #6 (N=6) having a turn-on level voltage are supplied first. Here, the first supply period is a period in which the scan signals SCAN #1 to SCAN #6 having a turn-on level voltage are supplied first for one frame time. In the case of the fifth method, the first supply period may correspond to a sensing period SENSING.

Referring to FIGS. 19 and 20, for one frame time, the gate driving circuit 130 may supply the scan signals SCAN #1 to SCAN #6 having a turn-on level voltage to the six scan lines SCL during a second supply period for each of the six scan lines SCL, in which the scan signals SCAN #1 to SCAN #6 (N=6) having a turn-on level voltage are supplied second. Here, the second supply period is a period in which the scan signals SCAN #1 to SCAN #6 having a turn-on level voltage are supplied second for one frame time. In the case of the fifth method, the second supply period may be a data writing period DW.

Referring to FIGS. 19 and 20, according to the fifth method, the second supply periods of the six scan lines SCL may have different time lengths. Alternatively, as described above with reference to FIGS. 17 and 18, according to the fourth method, the second supply periods of the six scan lines SCL may start non-sequentially at different time points. Alternatively, data voltages Vdata of the six subpixel lines SPL #1 to SPL #6 supplied to subpixels SP may be different during the second supply periods of the six scan lines SCL.

Referring to FIGS. 19 and 20, according to the fifth method, when the second supply periods of the six scan lines SCL have different time lengths, as a time interval between the first supply period and the second supply period for each of the six scan lines SCL becomes shorter, the time length of the second supply period may become shorter. That is, as a time length of a first holding period HOLD1 for each of the six scan lines SCL becomes shorter, the time length of the second supply period corresponding to the data writing period DW may become shorter.

Referring to FIGS. 19 and 20, according to the fifth method, in each of the M blocks BLK #1 to BLK #M, when the second supply periods of the six scan lines SCL have different lengths, the second supply periods of the six scan lines SCL start sequentially.

Referring to FIGS. 19 and 20, according to the fifth method, in each of the M blocks BLK #1 to BLK #M, in a first scan line SCL and an $6^{th}$ (N=6) scan line SCL of the six scan lines SCL, a time interval between a first supply period and a second supply period of the first scan line SCL may be shorter than a time interval between a first supply period and a second supply period of the $6^{th}$ (N=6) scan line SCL. In this case, a time length of the second supply period of the first scan line SCL may be shorter than a time length of the second supply period of the $6^{th}$ (N=6) scan line SCL.

Referring to FIGS. 19 and 20, according to the fifth method, in each of the M blocks BLK #1 to BLK #M, as a first holding period HOLD1 of a subpixel line becomes shorter, a data writing period DW of the subpixel line may become shorter.

When a first holding period HOLD1 of a subpixel line is short, the subpixel line may have low luminance. However, when a data writing period DW of the subpixel line is reduced so that the storage capacitor Cst is less charged, a voltage difference (for example, Vgs) between a first node N1 and a second node N2 of the driving transistor DRT may be increased to increase the luminance. Accordingly, low luminance may be compensated for in a direction in which the low luminance is increased. On the contrary, when a first holding period HOLD1 of a subpixel line is long, the subpixel line may have high luminance. However, when a data writing period DW of the subpixel line is increased so that the storage capacitor Cst is charged more, the voltage difference (for example, Vgs) between the first node N1 and the second node N2 of the driving transistor DRT may be reduced to decrease the luminance. Accordingly, high luminance may be compensated for in a direction in which the high luminance is decreased.

Accordingly, in each of the M blocks BLK #1 to BLK #M, luminance deviations of N subpixel lines SPL #1 to SPL #N may be similar to each other. Accordingly, a luminance deviation at a block boundary may also be reduced.

Meanwhile, in block driving according to a sixth method, the gate driving circuit 130 of the light-emitting display device 100 according to aspects of the present disclosure may supply different data voltages Vdata to subpixels SP of six subpixel lines SPL #1 to SPL #6 during a second supply period for each of six scan lines SCL in each of M blocks BLK #1 to BLK #M. In this case, the block driving may be operated at the same driving timing as the block driving according to the first method in FIGS. 8 and 9.

Accordingly, a luminance deviation between the six subpixel lines SPL #1 to SPL #6 included in each of the M blocks BLK #1 to BLK #M may be cancelled. In addition, gamma characteristics corresponding to the six subpixel lines SPL #1 to SPL #6 included in each of the M blocks BLK #1 to BLK #M may be set to a level, in which a luminance deviation may be cancelled, so as to be applied to all gray scales. For example, among the six subpixel lines SPL #1 to SPL #6 included in each of the M blocks BLK #1 to BLK #M, even when gray scales are the same, a gamma voltage used to generate a data voltage Vdata supplied to a first subpixel line may be different from a gamma voltage used to generate a data voltage Vdata supplied to a last subpixel line.

Hereinafter, a block driving method according to the fourth method described with reference to FIGS. 17 and 18, a block driving method according to the fifth method described with reference to FIGS. 19 and 20, and a block driving method according to the sixth method using an adjustment of the data voltage Vdata will be briefly described again with reference to FIG. 21.

Figure 21:
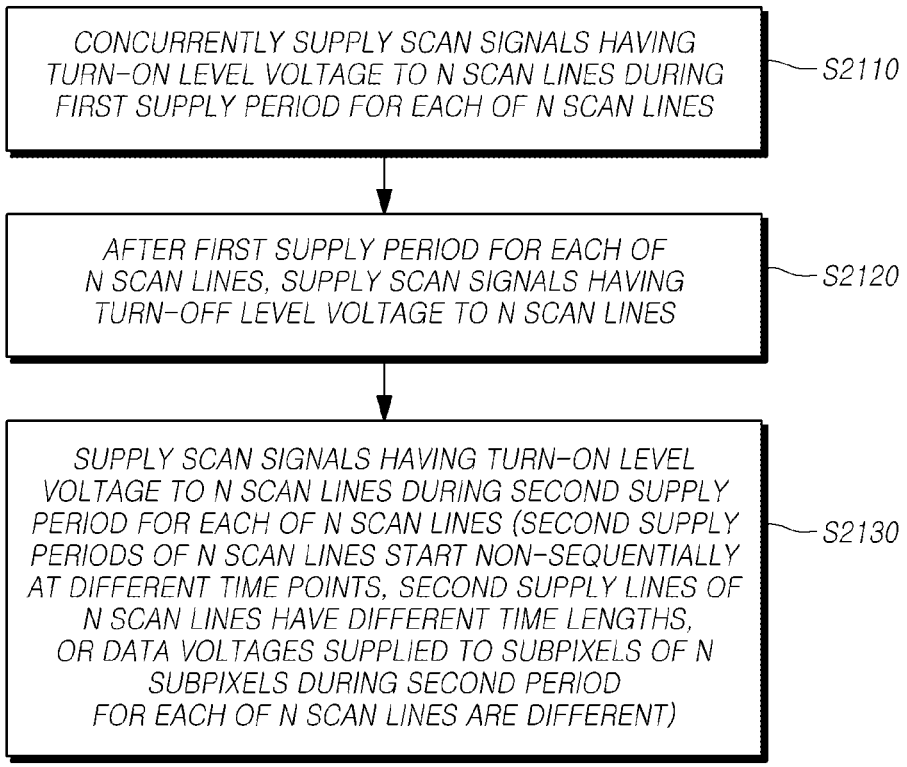
FIG. 21 is a flowchart of a method of driving a light-emitting display device according to the present disclosure.

FIG. 21 is a flowchart of a method of driving the light-emitting display device 100 according to aspects of the present disclosure.

Referring to FIG. 21, the method of driving the light-emitting display device 100 according to the aspects of the present disclosure may include concurrently supplying scan signals SCAN #1 to SCAN #N having a turn-on level voltage to six scan lines SCL of a plurality of scan lines SCL during a first supply period for each of N scan lines SCL, in which the scan signals SCAN #1 to SCAN #N having a turn-on level voltage are supplied first for one frame time (wherein N is a natural number of two or more) (S2110), after the first supply period for each of the six scan lines SCL, supplying the scan signals SCAN #1 to SCAN #6 having a turn-off level voltage to the six scan lines SCL for one frame time (S2120), and supplying the scan signals SCAN #1 to SCAN #6 having a turn-on level voltage to the six scan lines SCL during a second supply period for each of the N scan lines SCL, in which the scan signals SCAN #1 to SCAN #N having a turn-on level voltage are supplied second for one frame time (S2130).

The second supply periods of the six scan lines SCL may start non-sequentially at different times, the second supply periods of the six scan lines SCL may have different time lengths, or data voltages Vdata supplied to subpixels SP of the six subpixel lines SPL #1 to SPL #6 during the second supply period for each of the six scan lines SCL may be different.

According to aspects of the present disclosure described above, through block driving, sensing and compensating times may be secured during driving of an image display.

In addition, according to the aspects of the present disclosure, it is possible to perform block driving according to various methods capable of preventing luminance non-uniformity due to block driving.

Furthermore, according to aspects of the present disclosure, during block driving, it is possible to reduce or remove a luminance deviation in a block.

In addition, according to aspects of the present disclosure, during block driving, it is possible to reduce or remove a luminance deviation at a block boundary.

The above description has been presented to enable any person skilled in the art to make and use the technical idea of the present disclosure, and has been provided in the context of a particular application and its requirements. Various modifications, additions, and substitutions to the described aspects will be readily apparent to those skilled in the art, and the general principles defined herein may be applied to other aspects and applications without departing from the spirit and scope of the present disclosure. The above description and the accompanying drawings provide an example of the technical idea of the present disclosure for illustrative purposes only. That is, the disclosed aspects are intended to illustrate the scope of the technical idea of the present disclosure. Thus, the scope of the present disclosure is not limited to aspects shown but is to be accorded the widest scope consistent with the claims. The scope of protection of the present disclosure should be construed based on the following claims, and all technical ideas within the scope of equivalents thereof should be construed as being included within the scope of the present disclosure.

What is claimed is:

1. A light-emitting display device comprising:

a display panel in which a plurality of data lines and a plurality of scan lines are disposed and including a plurality of subpixels which each includes a light-emitting element, a driving transistor configured to control a current flowing in the light-emitting element, a scan transistor configured to transmit a data voltage to the driving transistor, and a storage capacitor configured to maintain a voltage for a certain time and which are disposed in a matrix form;

a data driving circuit configured to drive the plurality of data lines;

a gate driving circuit configured to drive the plurality of scan lines; and a controller configured to control the data driving circuit and the gate driving circuit, wherein the plurality of subpixels are grouped into M blocks, each of the M blocks includes N subpixel lines, and the N subpixel lines included in each of the M blocks correspond to N scan lines, wherein M is a natural number of 2 or higher and N is a natural number of 2 or higher, wherein, for one frame time, the subpixels disposed in the N subpixel lines included in each of the M blocks emit light concurrently, and for the one frame time, the gate driving circuit concurrently supplies scan signals having a turn-on level voltage to the N scan lines during a first supply period for each of the N scan lines, in which the scan signals having a turn-on level voltage are supplied first, concurrently or sequentially supplies the scan signals having a turn-on level voltage to the N scan lines during a second supply period for each of the N scan lines, in which the scan signals having a turn-on level voltage are supplied second, and supplies the scan signals having a turn-off level voltage to the N scan lines during a period between the first supply period and the second supply period for each of the N scan lines, wherein time intervals of the N scan lines between the first supply period and the second supply period are the same or have a difference within a preset range.

2. The light-emitting display device of claim 1, wherein the first supply periods of the N scan lines start concurrently and end sequentially, and wherein the second supply periods of the N scan lines start sequentially and end sequentially.

3. The light-emitting display device of claim 1, wherein the first supply periods of the N scan lines start concurrently and end concurrently, and wherein the second supply periods of the N scan lines start concurrently and end sequentially.

4. The light-emitting display device of claim 1, wherein, for the one frame time, a driving time of each of the N subpixel lines included in each of the M blocks includes:

a sensing period in which the scan signals having a turn-on level voltage are supplied to the N scan lines;

a first holding period in which the scan signals having a turn-off level voltage are supplied to the N scan lines;

a data writing period in which the scan signals having a turn-on level voltage are supplied to the N scan lines;

a second holding period in which the scan signals having a turn-off level voltage are supplied to the N scan lines; and an emission period in which the light-emitting elements included in the subpixels disposed in the N subpixel lines emit light concurrently, wherein the first holding periods corresponding to the N subpixel lines have the same time length.

5. The light-emitting display device of claim 4, wherein the display panel further includes a plurality of sense lines, a plurality of reference lines, a plurality of emission control lines, and a plurality of driving voltage lines, wherein the gate driving circuit drives the plurality of scan lines, the plurality of sense lines, and the plurality of emission control lines, wherein all or some of the plurality of subpixels further each include a sense transistor and an emission control transistor in addition to the light-emitting element, the driving transistor, the scan transistor, and the storage capacitor, wherein the light-emitting element includes a first electrode, a second electrode, and a light-emitting layer positioned between the first electrode and the second electrode, wherein the driving transistor drives the light-emitting element and includes a first node, a second node, and a third node, wherein the scan transistor controls a connection between the first node of the driving transistor and the corresponding data line of the plurality of data lines in response to the scan signal supplied from a corresponding scan line of the plurality of scan lines, wherein the sense transistor controls a connection between the second node of the driving transistor electrically connected to the first electrode of the light-emitting element and a corresponding reference line of the plurality of reference lines in response to a sense signal supplied from a corresponding sense line of the plurality of sense lines, wherein the emission control transistor controls a connection between the third node of the driving transistor and a corresponding driving voltage line of the plurality of driving voltage lines in response to an emission control signal supplied from a corresponding emission control line of the plurality of emission control lines or controls a connection between the second node of the driving transistor and the first electrode of the light-emitting element, wherein the storage capacitor is electrically connected between the first node and the second node of the driving transistor, and wherein K sense lines for supplying the sense signals to the subpixels disposed in the N subpixel lines and K emission control lines for supplying the emission control signals to the subpixels disposed in the N subpixel lines are disposed in each of the M blocks, wherein K is one or more and N or less.

6. The light-emitting display device of claim 5, wherein the sensing period includes an initialization period and a sampling period, wherein the gate driving circuit supplies the scan signals having a turn-on level voltage to the N scan lines during the initialization period and the sampling period in the sensing period, supplies the scan signals having a turn-off level voltage to the N scan lines during the first holding period, supplies the scan signals having a turn-on level voltage to the N scan lines during the data writing period, and supplies the scan signals having a turn-off level voltage to the N scan lines during the second holding period and the emission period, wherein the gate driving circuit supplies the sense signals having a turn-on level voltage to the K sense lines disposed in a corresponding block of the M blocks during the initialization period in the sensing period, supplies the sense signals having a turn-off level voltage to the K sense lines during the sampling period in the sensing period, and continuously supplies the sense signals having a turn-off level voltage during the first holding period, the data writing period, the second holding period, and the emission period, and wherein the gate driving circuit supplies the emission control signals having a turnoff level voltage to the K emission control lines disposed in a corresponding block of the M blocks during the initialization period in the sensing period, supplies the emission control signals having a turn-on level voltage to the K emission control lines during the sampling period in the sensing period, supplies the emission control signals having a turn-off level voltage to the K emission control lines during the first holding period, the data writing period, and the second holding period, and supplies the emission control signals having a turn-on level voltage to the K emission control lines during the emission period.

7. The light-emitting display device of claim 4, wherein, for the one frame time, the sensing periods of the N subpixel lines start concurrently, the first holding periods of the N subpixel lines start sequentially, the data writing periods of the N subpixel lines start sequentially, the second holding periods of the N subpixel lines start sequentially, and the emission periods of the N subpixel lines start concurrently, wherein, for the one frame time, the driving time of each of the N subpixel lines further includes a holding deviation compensation period that proceeds between the sensing period and the first holding period, wherein the turn-on level voltage of the scan signal in the sensing period is maintained in the holding deviation compensation period, and a time length of the holding deviation compensation period is zero or more, and wherein, for each of the N subpixel lines, the first supply period is a period including the sensing period and the holding deviation compensation period, and the second supply period is the data writing period.

8. The light-emitting display device of claim 7, wherein the gate driving circuit concurrently supplies the scan signals having a turn-on level voltage to the N scan lines during the sensing period, maintains and supplies the scan signals having a turn-on level voltage supplied during the sensing period to the N scan lines during the holding deviation compensation period and sequentially supplies the scan signals having a turn-off level voltage to the N scan lines during the first holding period, wherein the gate driving circuit concurrently supplies the sense signals having a turn-on level voltage to the K sense lines during the initialization period in the sensing period, concurrently supplies the sense signals having a turn-off level voltage to the K sense lines during the sampling period in the sensing period, concurrently supplies the sense signals having a turn-off level voltage to the K sense lines during the holding deviation compensation period, and concurrently supplies the sense signals having a turn-off level voltage to the K sense lines during the first holding period, wherein the gate driving circuit concurrently supplies the emission control signals having a turn-off level voltage to the K emission control lines during the initialization period in the sensing period, concurrently supplies the emission control signals having a turn-on level voltage to the K emission control lines during the sampling period in the sensing period, concurrently supplies the emission control signals having a turn-off level voltage during the holding deviation compensation period, and concurrently supplies the emission control signals having a turn-off level voltage during the first holding period, and wherein a time length of the holding deviation compensation period with respect to a first subpixel line of the N subpixel lines is zero.

9. The light-emitting display device of claim 7, wherein the holding deviation compensation periods of the N subpixel lines included in each of the M blocks start concurrently and end sequentially, and wherein the holding deviation compensation periods of the N subpixel lines have different time lengths, and for each of the N subpixel lines, as an interval between the sensing period and the data writing period becomes longer, the holding deviation compensation period becomes longer.

10. The light-emitting display device of claim 4, wherein, for the one frame time, the sensing periods of the N subpixel lines start concurrently, the first holding periods of the N subpixel lines start concurrently, and the data writing periods of the N subpixel lines start concurrently, the second holding periods of the N subpixel lines start sequentially, and the emission periods of the N subpixel lines start concurrently, wherein, for each of the N subpixel lines, the first supply period is the sensing period, and the second supply period is the data writing period, and wherein the first holding periods of the N subpixel lines start concurrently and end concurrently, the data writing periods of the N subpixel lines start concurrently and end sequentially, and the data writing periods of the N subpixel lines have different time lengths.

11. The light-emitting display device of claim 10, wherein the gate driving circuit concurrently supplies the scan signals having a turn-on level voltage to the N scan lines during the sensing period, concurrently supplies the scan signals having a turn-off level voltage during the first holding period, concurrently supplies the scan signals having a turn-on level voltage during the data writing period, sequentially supplies the scan signals having a turn-off level voltage during the second holding period, and continuously supplies the scan signals having a turn-off level voltage during the emission period, wherein the gate driving circuit concurrently supplies the sense signals having a turn-on level voltage to the K sense lines during the initialization period in the sensing period, concurrently supplies the sense signals having a turn-off level voltage to the K sense lines during the sampling period in the sensing period, and continuously supplies the sense signals having a turn-off level voltage to the K sense lines during the first holding period, the data writing period, the second holding period, and the emission period, and wherein the gate driving circuit concurrently supplies the emission control signals having a turn-off level voltage to the K emission control lines during the initialization period in the sensing period, concurrently supplies the emission control signals having a turn-on level voltage to the K emission control lines during the sampling period in the sensing period, continuously supplies the emission control signals having a turn-off level voltage to the K emission control lines during the first holding period, the data writing period, and the second holding period, and concurrently supplies the emission control signals having a turn-on level voltage to the K emission control lines during the emission period.

12. The light-emitting display device of claim 1, wherein, for the one frame time, during the first supply period for each of the N scan lines, a voltage difference between two ends of each of the storage capacitors is changed according to a threshold voltage of each of the driving transistors included in the subpixels disposed in the N subpixel lines.

13. A method of driving a light-emitting display device, which includes a display panel in which a plurality of data lines and a plurality of scan lines are disposed and including a plurality of subpixels which each include a light-emitting element, a driving transistor, a scan transistor, and a storage capacitor and which are disposed in a matrix form, a data driving circuit configured to drive the plurality of data lines, and a gate driving circuit configured to drive the plurality of scan lines, the method comprising:

concurrently supplying scan signals having a turn-on level voltage to N scan lines of the plurality of scan lines during a first supply period for each of the N scan lines, in which the scan signals having a turn-on level voltage are supplied first for one frame time, wherein N is two or more;

supplying the scan signals having a turn-off level voltage to the N scan lines after the first supply period for each of the N scan lines, in which the scan signals having a turn-on level voltage are supplied first for the one frame time; and concurrently or sequentially supplying the scan signals having a turn-on level voltage to the N scan lines during a second supply period for each of the N scan lines for the one frame time, wherein the plurality of subpixels are grouped into M blocks, each of the M blocks includes N subpixel lines, and the N subpixel lines included in each of the M blocks correspond to the N scan lines, wherein M is a natural number of two or more and N is a natural number of two or more, wherein, for the one frame time, the subpixels disposed in the N subpixel lines included in each of the M blocks emit light concurrently, and time intervals of the N scan lines between the first supply period and the second supply period are the same or have a difference within a preset range.

14. A light-emitting display device comprising:

a display panel in which a plurality of data lines and a plurality of scan lines are disposed and including a plurality of subpixels which each include a light-emitting element, a driving transistor configured to control a current flowing in the light-emitting element, a scan transistor configured to transmit a data voltage to the driving transistor, and a storage capacitor configured to maintain a voltage for a certain time and which are disposed in a matrix form;

a data driving circuit configured to drive the plurality of data lines;

a gate driving circuit configured to drive the plurality of scan lines; and a controller configured to control the data driving circuit and the gate driving circuit, wherein the plurality of subpixels are grouped into M blocks, each of the M blocks includes N subpixel lines, and the N subpixel lines included in each of the M blocks correspond to N scan lines, wherein M is a natural number of two or more and N is a natural number of two or more, for one frame time, the subpixels disposed in the N subpixel lines included in each of the M blocks emit light concurrently, and for the one frame time, the gate driving circuit concurrently supplies scan signals having a turn-on level voltage to the N scan lines during a first supply period for each of the N scan lines, in which the scan signals having a turn-on level voltage are supplied first, and supplies the scan signals having a turn-on level voltage to the N scan lines during a second supply period for each of the N scan lines, in which the scan signals having a turn-on level voltage are supplied second, wherein the second supply periods of the N scan lines start non-sequentially at different time points, and wherein the second supply periods of the N scan lines have different time lengths, or during the second supply periods of the N scan lines, data voltages supplied to the subpixels of the N subpixel lines are different.

15. The light-emitting display device of claim 14, wherein, when the second supply periods of the N scan lines start non-sequentially at the different time points, in a first scan line and an Nth scan line of the N scan lines, a time interval between the first supply period and the second supply period of the first scan line and a time interval between the first supply period and the second supply period of the Nth scan line are the same or have a difference within a preset range.

16. The light-emitting display device of claim 15, wherein, when the second supply periods of the N scan lines have the different time lengths, as a time interval between the first supply period and the second supply period for each of the N scan lines becomes shorter, the time length of the second supply period becomes shorter.

17. The light-emitting display device of claim 16, wherein, when the second supply periods of the N scan lines have the different time lengths, wherein the second supply periods of the N scan lines start sequentially, wherein, in the first scan line and the Nth scan line of the N scan lines, the time interval between the first supply period and the second supply period of the first scan line is shorter than the time interval between the first supply period and the second supply period of the $N^{th}$ scan line, and wherein the time length of the second supply period of the first scan line is shorter than the time length of the second supply period of the $N^{th}$ scan line.

18. The light-emitting display device of claim 16, wherein, among the N subpixel lines included in each of the M blocks, a gamma voltage used to generate a data voltage supplied to the first subpixel line is different from a gamma voltage used to generate a data voltage supplied to the Nth subpixel line.

19. A method of driving a light-emitting display device, which includes a display panel in which a plurality of data lines and a plurality of scan lines are disposed and including a plurality of subpixels which each include a light-emitting element, a driving transistor, a scan transistor, and a storage capacitor and which are disposed in a matrix form, a data driving circuit configured to drive the plurality of data lines, and a gate driving circuit configured to drive the plurality of scan lines, the method comprising:

concurrently supplying scan signals having a turn-on level voltage to N scan lines of the plurality of scan lines during a first supply period for each of the N scan lines, in which the scan signals having a turn-on level voltage are supplied first for one frame time, wherein N is two or more;

supplying the scan signals having a turn-off level voltage to the N scan lines after the first supply period for each of the N scan lines for the one frame period; and supplying the scan signals having a turn-on level voltage to the N scan lines during a second supply period for each of the N scan lines, in which the scan signals having a turn-on level voltage are supplied second for the one frame time, wherein the plurality of subpixels are grouped into M blocks, each of the M blocks includes N subpixel lines, and the N subpixel lines included in each of the M blocks correspond to the N scan lines, wherein M is a natural number of two or more and N is a natural number of two or more, wherein, for the one frame time, the subpixels disposed in the N subpixel lines included in each of the M blocks emit light concurrently, wherein the second supply periods of the N scan lines start non-sequentially at different time points, and wherein the second supply periods of the N scan lines have different time lengths, or during the second supply period for each of the N scan lines, data voltages supplied to the subpixels of the N subpixel lines are different.

* * * * *